US007245081B2

(12) United States Patent
Ashida et al.

(10) Patent No.: US 7,245,081 B2
(45) Date of Patent: Jul. 17, 2007

(54) HIGH-INTENSITY DISCHARGE LAMP WITH PARTICULAR METAL HALIDE GAS FILLING AND LIGHTING DEVICE

(75) Inventors: Seiji Ashida, Kanagawa-ken (JP); Hisashi Honda, Kanagawa-ken (JP); Shinji Atago, Kanagawa-ken (JP); Satoshi Iwasawa, Kanagawa-ken (JP)

(73) Assignee: Osram-Melco Toshiba Lighting Ltd., Kanagawa-Ken (JP)

( * ) Notice: Subject to any disclaimer, the term of this patent is extended or adjusted under 35 U.S.C. 154(b) by 94 days.

(21) Appl. No.: 10/790,174

(22) Filed: Mar. 2, 2004

(65) Prior Publication Data

US 2004/0189212 A1 Sep. 30, 2004

(30) Foreign Application Priority Data

| | | |
|---|---|---|
| Mar. 3, 2003 | (JP) | 2003-056146 |
| Apr. 30, 2003 | (JP) | 2003-125075 |
| Aug. 29, 2003 | (JP) | 2003-306697 |
| Nov. 11, 2003 | (JP) | 2003-381297 |
| Nov. 14, 2003 | (JP) | 2003-385043 |

(51) Int. Cl.
*H01J 17/20* (2006.01)
*H01J 61/12* (2006.01)

(52) U.S. Cl. ..... 313/637; 313/634

(58) Field of Classification Search ..... 313/637, 313/634, 636, 638; 315/82, 358
See application file for complete search history.

(56) References Cited

U.S. PATENT DOCUMENTS 4,024,425 A * 5/1977 Higashi et al. ..... 313/562
4,503,356 A * 3/1985 Kobayashi et al. ..... 313/634
4,935,668 A * 6/1990 Hansler et al. ..... 315/82
5,059,865 A * 10/1991 Bergman et al. ..... 315/82
5,221,876 A * 6/1993 Bergman et al. ..... 315/82

FOREIGN PATENT DOCUMENTS

| | | |
|---|---|---|
| JP | 62-66556 | 3/1987 |
| JP | 7-130331 | 5/1995 |
| JP | 3293499 | 4/2002 |
| JP | 2003-16998 | 1/2003 |

* cited by examiner

*Primary Examiner*—Nimeshkumar D. Patel
*Assistant Examiner*—Kevin Quarterman
(74) *Attorney, Agent, or Firm*—Pillsbury Winthrop Shaw Pittman, LLP

(57) ABSTRACT

A high-intensity discharge lamp connected to a lighting device has various superior emission properties such as efficiency. The discharge lamp includes a translucent ceramic discharge vessel, in which a pair of electrodes and a discharge medium are inserted. The lamp further includes an outer jacket, in which the arc tube is disposed, and a pair of feeder members. The discharge medium has metal halides including those of Na, Tl and Tm or Na, Tl, In and Tm, and the ratio (MTm/M) of the weight of the gross sealed mass M of the metal halides to the filled mass MTm of the Tm halide is about $0.4 \leqq MTm/M \leqq 0.9$. The deviation in chromaticity (d.u.v.) on the x-y chromaticity coordinates (CIE 1931) for the overall operating position during the life of the lamp is within the range of about −0.006 to +0.010.

20 Claims, 10 Drawing Sheets

HIGH-INTENSITY DISCHARGE LAMP WITH PARTICULAR METAL HALIDE GAS FILLING AND LIGHTING DEVICE

BACKGROUND OF THE INVENTION

1. Field of the Invention

The invention relates to a high-intensity discharge lamp and a lighting device.

2. Description of Related Art

In addition to being used to light open spaces such as roads, plazas, stadiums and the like, and as the light source for shops and vehicles, high-intensity discharge lamps, for example metal halide discharge lamps, are also widely used as the light source for optical devices such as overhead projectors and liquid crystal projectors.

A metal halide lamp is a discharge lamp having an electrode structure and an arc tube filled with a discharge medium. The discharge medium generally includes a metal halide, mercury or a noble gas. The atomic spectral lines or the molecular spectrum of the filled metal halide are used as the source of emission to provide a lamp with higher luminous efficacy, higher correlated color temperature and higher color rendition than a mercury lamp.

Halides such as metal iodides or metal bromides, used as the source of emission for this metal halide lamp, in addition to mercury, and including metals such as Na, In, Tl, Li and Cs, or rare earth metals such as Dy, Ho, Tm, Sc, Nd, Ce, fill the arc tube, thereby creating a structure which offers good emission properties.

However, it may be difficult to develop a single discharge lamp with excellent values over a range of characteristics, such as efficiency or correlated color temperature. Thus, rendition and life due to failings like color rendition may be poor despite high efficiency. Conversely, efficiency may still be poor despite good color rendition, or may vary with operating position of the lamp.

In recent years, metal halide lamps with improved efficiency, correlated color temperature, and color rendition and life have been obtained. These lamps generally include a compact arc tube having translucent ceramic materials. Translucent ceramic materials have superior resistance to corrosion and heat, and react less with metal halides than does quartz glass, The application of such metal halide lamps with filled metal halides has expanded, although they have not been much used to provide light in various directions. Thus, if this type of lamp is not changed with the operating position, the lamp may fade or have a shortened life due to great variations in its properties and reduction in efficiency or color variation on the illuminated surface with changes in operating position.

JP-PS 3293499 discloses a high-intensity discharge lamp with metal halides, including rare earth metal halides and sodium halide, filled within an arc tube including a translucent ceramic chamber. In this reference, the sodium halide is mixed in at a relative weight of 10–100% with respect to the quantity of rare earth metal halides (DyI 55 Wt %: NaI 30 Wt %: TlI 15 Wt %). JP-PS 3293499 discloses that, in addition to delivering excellent emission characteristics having a luminous efficacy of 96 Lm/W, a correlated color temperature of 4100K (3500–5000K), and an average color rendition index value (Ra) of 95, this lamp offers a low extinguish voltage difference between vertical operation and horizontal operation.

However, when measuring the characteristics of a lamp disclosed in JP-PS 3293499, the desired emission characteristics were not always obtained from lamps with a power rating different from the standard power rating cited in the embodiments of Reference 1.

JP-PS 2003-16998 does not disclose the dimensions that can be used to determine the evaporation temperature (coldest point) of the metal halides filled within the arc tube, or the dimensions of the structure of the lamp. In addition, the cited characteristics were not obtained for some varieties of these selected rare earth halides.

JP-PS 2003-16998 discloses a lamp having high luminous efficacy (117 Lm/W and above). This reference discloses that control of the lumen maintenance factor is achieved with a metal halide lamp including an arc tube and a translucent ceramic chamber filled with a mixture (100 wt % in total) of cerium halide (20–69 wt %), sodium halide (30–79 wt %), thallium halide and indium halide (Tl and In halides comprising a combined weight of 1–20 wt %).

However, while high luminous efficacy and control of the lumen maintenance factor may be provided with lamps constructed according to the specifications of JP-PS 2003-16998, in addition to the light emitted from the lamp being very green, the average rendition index values generally fall to 75 and below. This means that this lamp may not be suited for application in retail outlets for lighting outdoor spaces.

JP-PS 7-130331 discloses, a lamp where color temperature stability and good color rendition are done by adjusting the ratio of the filled metal halides. In this reference, a lamp with a power rating of 30–40 W has a tube wall loading of 20–26 W/cm$^2$ and a color temperature of 2800–3700K.

JP-PS 62-66556 discloses a metal halide lamp having an arc tube and a translucent ceramic chamber which radiates light with good luminous efficacy (103 Lm/W and above), correlated color temperature (3600K), average color rendition index value (Ra=87) and chromacity coordinates (x=0.401, y=0.395). The arc tube of the lamp is filled with a mixture (100 wt % in total) of thulium halide (16 wt %), sodium halide (77 wt %) and thallium halide (7 wt %).

However, experiments have shown that the light emitted during the life of the lamp, disclosed in JP-PS 62-66556, was extremely red and that the variation in correlated color temperature with lighting direction (vertical lighting and horizontal lighting) was 500 K and more. Furthermore, it has been noted that an increase in the average color rendition index values over the life of the lamp led to a deterioration in luminous efficacy, and a dramatic decrease in the lumen maintenance factor. This may be due to the relative low weight of Tm halide (16 wt %) and the relative high weight of the sodium halide.

SUMMARY OF THE INVENTION

The inventors have been able to obtain excellent results for various emission properties by selecting and testing various metal materials suitable for emission, their proportions, and the amounts to be filled, and in particular by adjusting the range over which the quantity of Tm halide should be included as disclosed below.

In an aspect of the invention there is provided a high-intensity discharge lamp, such as a metal halide lamp which emits a white light, and a lighting device fitted with this discharge lamp. The lighting device has various superior emission properties in areas such as light luminous efficacy (95 lm/W-130 lm/W or more), correlated color temperature (3500–5000K), color rendition (average color rendition index value (Ra) 75–95), life, and low variation in correlated color temperature and chromacity with operating positions. This is achieved in an embodiment of the invention by adjusting the metallic materials used for emission, the ratio of filling material, and their x-y chromacity.

In an embodiment of the invention there is provided a high-intensity discharge lamp including an arc tube, the arc tube including:

a translucent ceramic discharge chamber that defines a discharge volume, said chamber having a pair of end sections provided at both ends of a central section;

a pair of feedthroughs, each of said feedthroughs being hermetically sealed within one of said end sections respectively; and a pair of electrodes, each of said electrodes comprising a tip that extends towards the central section and is connected to one of said feedthroughs, wherein the discharge chamber is filled with a discharge medium including a metal halide and a starting gas, the metal halide comprising at least halides of Na, Tl, Tm, and wherein the ratio (MTm/M) of the mass MTm of Tm halide to the total mass M of said metal halide is within a range of about $0.4 \leqq MTm/M \leqq 0.9$.

In an embodiment of the invention, the high-intensity discharge lamp uses Tm, which delivers multiple emission peaks in the blue/green domain (around 450–530 nm), Tl, which delivers an emission peak in the green domain (around 535 nm) and Na, which delivers an emission peak in the red domain (around 590 nm) as the main components of the halides filled in as the light-emitting metal material. In this embodiment of the invention, the high intensity discharge lamp regulates the filled quantity MTm (mg) of the Tm halide with respect to the total filled quantity M (mg) of these metal halides.

With the Tm halide kept in said range, it may be possible, in this embodiment of the invention, to provide a high-intensity discharge lamp with improved quality and well-balanced emission properties, such as improved luminous efficacy delivering a spectrum in the blue green domain around 450–530 nm with no restrictions on the operating position.

However, if the weight ratio MTm/M of the filled quantity MTm (mg) of the Tm halide to the total quantity M (mg) of filled metal halide is around 0.4 (40%) or less, it may become difficult to reach a balance between luminous efficacy and color adjustment for the remaining Na and Tl. Therefore, in order to improve luminous efficacy it may be desirable to increase the quantity of sodium in an embodiment of the invention. However if the quantity of sodium is increased, the correlated color temperature may fall below 3500K, the d.u.v. value may become strongly negative, and values for correlated color temperature and d.u.v. may vary greatly over the lifetime of the lamp. At the same time, even if the quantity of Tl is increased, Tl may only emit light on its brilliance atomic line spectrum. As a result, it may be difficult to improve the luminous efficacy, and the value of d.u.v. (deviation of chromacity from Black Body Locus in u-v coordinates) may become strongly positive, making it difficult to achieve the desired characteristics.

Moreover, if the ratio of MTm/M exceeds 0.9 (90%), the discharge chamber may react with the Tm halide, If such a reaction occurs, the lumen maintenance factor may deteriorate. However even within the said range, it may be desirable to hold the value of MTm/M to within 0.55–0.75 (55–75%) in an embodiment of the invention.

Definitions of terms to be used and their technical meaning, except where otherwise specified, will now be given.

Suitable materials that can be used to form the discharge chamber of the arc tube include ceramics such as sapphire, aluminum oxide (alumina), yttria-alumina-garnet (YAG), yttrium oxide (YOX), and aluminum nitrite (AlN) or any materials having superior translucence, heat resistance, and resistance to corrosion by halides.

The shape of the discharge chamber may be tubular, cylindrical with a central bulge, spherical, or a combination of these shapes. In embodiments of the invention, both ends of the chamber are formed with a seal which forms a hermetic seal either directly or via a small diameter tubular body connected to the ends. Where the chamber is made of ceramic, this sealed portion can be formed using a metal, a ceramic or a cermet stopper. In an embodiment of the invention, the sealed portion is closed off with a filler such as a heat resistant adhesive or the like.

The translucence referred to above allows light to pass to the extent that the light emitted by the discharge can be released externally by passing through the tube, which is not necessarily transparent but may simply disperse the light. Portions like the small diameter tubes located at the end of the chamber, which are not directly involved in radiating light, may be made of opaque materials.

In an embodiment of the invention, the cylindrical, spherical or tubular shaped portion used to form the discharge space for the discharge chamber may be around 4–30 mm, with an internal length of around 30–90 mm, an internal volume of around 0.02–5.0 cc, and preferably between 0.2–4.5 cc. However, it should be understood that other shapes and dimensions may be used in other embodiments of the invention and that no restrictions are imposed on the rating of the lamp.

In an embodiment of the invention, the tube wall loading, which expresses the relationship between the wattage of the lamp W and the internal surface area of the discharge chamber, may be about 26 W/sq cm or more where the power is about 10–40 W, about 23 W/sq cm or more where the power is about 50–500 W, and about 13 W/sq cm or more where the power is about 500–1000 W.

In an embodiment of the invention, the chamber includes at least one pair of electrodes disposed so as to face one another. In this embodiment of the invention, the shafts of the electrodes are sealed in so as to pass through the sealed portion at both ends of the discharge chamber and the small diameter tubular sections, the material employed being tungsten W or doped tungsten. Furthermore, in this embodiment of the invention, the tips of the electrodes can be fitted with a coil including the above material where it may be necessary to increase the surface area and to provide good conditions for radiation of heat.

The section of the electrodes at the base of the shafts, in addition to fixing the position of the electrodes with respect to the discharge chamber as required, can be used to introduce current from the outside. This base section is electrically connected to and mechanically supported by the tip of the electrical feed-through, by welding or the like.

In an embodiment of the invention, the electrical feed-through, which is connected to the electrodes and support these electrodes, supplies the discharge current to the electrodes and may be fixed to the chamber. Where the discharge chamber is a ceramic chamber, the electrical feed-through may be connected both internally and externally to the stopper or may pass through the stopper itself, which is hermetically sealed within the small diameter tubular sections with a glass sealant material. In case the discharge chamber is made of quartz glass, the electrical feed-through may be connected to molybdenum Mo metal leaf or the like for a hermetic seal. In an embodiment of the present invention, the electrical feed-through conducts either directly or via another connecting conductor from the end of the discharge chamber to the outside and is used to support the arc tube.

In an embodiment of the invention, the material of the electrical feed-through for a ceramic discharge chamber may employ sealant metals such as niobium Nb, tantalum Ta, titanium Ti, zirconium Zr, hafnium Hf or vanadium V, and may be shaped in the form of a rod, a pipe or a coil. In an embodiment of the invention, this shape may be selected in accordance with the coefficient of heat expansion of the material used for the ceramic discharge chamber.

In an embodiment of the invention, the discharge medium includes halides consisting primarily of emissive metals such as sodium Na, thallium Tl and thulium Tm, the amalgam containing mercury Hg where necessary. In this embodiment of the invention, small quantities of indium In, calcium Ca, cesium Cs, lithium Li, magnesium Mg, rubidium Rb, cerium Ce, praseodymium Pr and other metal halides may be present. Halogens used may be iodine I, bromine Br, chlorine Cl or fluorine Fl, or a combination thereof.

In an embodiment of the invention, it may be desirable that the chamber be filled with a quantity of metal halides around 2–20 mg per 1 cc of the volume of the chamber. This quantity may be determined by the emission characteristics or the power of the lamp and the internal volume of the discharge chamber.

In an embodiment of the invention, the starter or buffer gas may include a noble gas such as argon Ar or neon Ne, which may be filled at a pressure of about 8 kPa–80 kPa (pascals) and may deliver a pressure of around 500 Kpa or more when the lamp is lit. If the pressure of this noble gas is less than about 8 kPa, it may be difficult to initiate the discharge as represented in the Paschen curve. Conversely, if the pressure of the noble gas is more than about 80 kPa, the initial voltage may be too high, and may become greater than the voltage resistance of the base 6.

If an outer jacket is used to enclose the arc tube, the outer jacket may be formed into A, AP, B, BT, ED, R, T or other shapes from glass such as quartz glass, hardened glass, semi-hardened glass or ceramic materials having translucence and heat resistance. The mount supporting the arc tube may be inserted from the open end, this open end being heated with a burner to fuse and seal the mount, thereby forming a sealed portion within which the mount is sealed. If a T-shape is used, (straight tube) the sealed portion may be formed at both ends.

The feeder members may be formed from a single independent member, but since it may be desirable that the portion sealed within the sealed portion be made of a material which can hermetically seal with the glass, it may be appropriate that parts like the feeder line within the outer jacket, the portion of the sealed member within the sealed section, or the external lead of the conductor external to the outer jacket be constructed with a plurality of materials joined together. In this embodiment of the invention, the material and dimensions are chosen to suit the quality, rating, weight, and material of the outer jacket of the arc tube.

In an embodiment of the invention, where the end of the discharge chamber has a small diameter tubular section, a coil is provided on the outer surface of the small diameter tubular sections opposed to the electrode shafts disposed within. This coil section may be connected to the opposite potential side of the electrode shafts in order to provide a supplementary electrode during start-up, thus enabling the lamp to have an easier start-up.

In an embodiment of the invention, the feeder wire portion external to the tube of the feeder member includes a metal material such as molybdenum Mo or tungsten W, and is electrically connected to the electrical feed-through at both ends of the arc tube. Thus, in addition to supplying electricity, the feeder also acts as a support member which supports the arc tube and inner shroud tube along the axis of the tube.

In yet another embodiment of the invention, the feeder wire located within the outer jacket may also be provided with a getter of zirconium Zr-aluminum Al alloy or the like to cleanse the inside of the outer jacket.

In an embodiment of the invention, an inner shroud tube may also be provided to surround the arc tube including a heat-resistant translucent material of ceramic, quartz glass or hard glass similar to the chamber. This inner shroud tube may maintain the temperature of the arc tube, allowing the light-emitting metal to function well. In this embodiment of the invention, in addition to improving the emission characteristics such as efficiency and color rendition, this inner shroud tube may also have a protective function in the eventuality that the arc tube chamber is subject to damage.

In yet another embodiment of the invention, an ultraviolet light source may also be provided within the outer jacket. This source provides ultraviolet radiation in the direction of the arc tube in order to assist start-up when the lamp is first lit.

In another aspect of the invention there is provided a high-intensity discharge lamp including an arc tube, the arc tube including:

a discharge chamber having a pair of end sections;

a pair of feedthroughs, each of said feedthroughs being hermetically sealed within one of said end sections of the discharge chamber, respectively; and a pair of electrodes, each of said electrodes being connected to one of said feedthroughs, wherein the discharge chamber is filled with a discharge medium including a metal halide and a starting gas, and wherein said metal halide comprises at least halides of Na, Tl, In, and Tm.

In yet another aspect of the invention, there is provided a high-intensity discharge lamp including an arc tube, the arc tube including:

a discharge chamber having a pair of end sections;

a pair of feedthroughs, each of said feedthroughs being hermetically sealed within one of said end sections of the discharge chamber; and a pair of electrodes, each of said electrodes being connected to one of said feedthroughs, wherein the discharge chamber is filled with a discharge medium including a metal halide and a starting gas, said metal halide comprising at least halides of Na, Tl, In, and Tm, wherein the ratio (MTm/M) of the mass MTm of said Tm halide to the total mass M of said metal halide is within a range of about $0.4 \leqq MTm/M \leqq 0.9$, and wherein the total mass of the halides of Na, Tl, In, Tm halides is greater than 90% of the total mass M of the metal halide.

The metal halide filled within the arc tube may include In which delivers an emission peak in the blue domain (around 450 nm). By controlling the quantity of this indium halide to an appropriate amount it may be possible to adjust the values of the color temperature and the d.u.v. without resulting in a dramatic deterioration in luminous efficacy.

It should be understood that in the present invention, the life of the lamp refers to the entire period from the first use of the lamp through its rated life.

In an embodiment of the invention, the high-intensity discharge lamp is such that the total weight of the Na, Tl and Tm halides within the arc tube include more than about 90% by weight of all the filled halides.

Where about 90% by weight or more of the total quantity of metal halides filled within the tube include Na, Tl and Tm halides, a spectral distribution close to the relative visibility curve may be derived. In this embodiment of the invention, stable life characteristics with little variation in the various properties of the lamp may be obtained. In consideration of its consumption in life time of the light, it may be desirable that the total amount included be about 95% by weight or more in order to improve stability.

In yet another embodiment of the invention, the high-intensity discharge lamp is such that Na, Tl, In and Tm halides include more than 90% by weight of the metal halides filled within the arc tube.

Where about 90% by weight or more of the total quantity of metal halides filled within the tube include Na, Tl, In and Tm halides, the average color rendition index may be raised and the d.u.v. values may approach those of the black body locus on the chromacity coordinates. In this embodiment of the invention, stable life characteristics with little variation in the various properties of the lamp may be obtained. In consideration of its consumption in life time of the light it may be desirable that the total amount included be about 95% by weight or more in order to improve stability.

In an embodiment of the invention, the high-intensity discharge lamp is such that the metal halides filled within the arc tube include Na, Tl, Tm and In halides. In this embodiment, the weight ratio of the total filling weight M (mg) of the metal halides and the filling weight MTm (mg) of the Tm halide (MTm/M) is $0.4 \leqq MTm/M \leqq 0.9$.

With the metal halide mixtures described above, a high luminous efficacy and a spectral distribution extremely close to the relative visibility curve shown in FIG. 17 may be obtained.

In an embodiment of the invention, the high-intensity discharge lamp is such that the metal halides filled within said arc tube include 90% by weight of Na, Tl, In, and Tm halides, with a weight ratio of the total filling weight M (mg) of the metal halides to the filling weight MTm (mg) of the Tm halide (MTm/M) within a range of about $0.4 \leqq MTm/M \leqq 0.9$.

With the composition of metal halides filled within the tube as described above, a white light having a good balance between luminous efficacy, color rendition, and d.u.v. values may be obtained. In addition, stable life characteristics with little variation in the various properties of the lamp may also be obtained. In consideration of its consumption in life time of the light, it may be desirable that the total amount included be around 95% by weight or more in order to improve stability.

In an embodiment of the invention, the high-intensity discharge lamp is such that the weight ratio (MTm+MTl+MIn)/M of the filling weight MTm (mg) of the Tm halide, the filling weight MTl(mg) of the Tl halide and the filling weight MIn (mg) of the In halide filled within said arc tube to the total filling weight M (mg) is in the range of about $0.61 \leqq (MTm+MTl+MIn)/M \leqq 0.9$. In this embodiment of the invention, the weight ratio of In halide (InX) to the total filling weight M (mg) of the metal halides is in the range of about $0.01 \leqq MIn/M \leqq 0.1$.

In an embodiment of the invention, the filling weight MTm+MTl+MIn(mg) of the Tm, Tl and In halides is regulated with respect to the total filling weight M(Mg) (=MNamg+MTlmg+MTmmg+MInmg). It should be noted that where the relative weight of said Tm, Tl and In halides ((MTm+MTl+MIn)/M) is about 0.61 (61 percent) or less, the color temperature may fall below 3500K.

In an embodiment of the invention, when the relative weight goes beyond about 0.9 (90%) the filling weight of the halides delivering red emitted light, such as Na, may decrease. In such a case, the desired emission characteristics may not be obtained, and thus it may be desirable to have the weight ratio (MTm+MTl+MIn)/M in the range of about 0.65–0.9 (65–90%).

If small quantities of indium halide are present, its effect may be felt, but if the total weight with respect to the metal halides exceeds about 10 wt %, the spectrum in the blue domain may become too strong and the luminous efficacy may deteriorate. In such a case, the blue light may be evident in the emitted color, but if it falls below about 0.01 (1%), the emitted light from the lamp may be slightly green due to insufficient emitted light (spectrum) in the blue domain in around 420–460 nm. As a result, the desired emitted light (color) properties may not be obtained.

In an embodiment of the invention, the high-intensity discharge lamp is such that the metal halides filled within the arc tube include at least one halide of Ce, Pr, Ca, Cs, Li, Mg and Rb.

If at least one halide of Ca, Cs, Li, Mg and Rb is selected and included together with Na halide, the red light emission may have an improved efficiency, and a greater arc stability may be obtained.

In an embodiment of the invention, it may be possible to further improve the efficiency of the light emission by adding in at least one of the halides of cerium Ce and praseodymium Pr, up to about 10% by weight of the total metal halides. However, when the amount exceeds about 10%, excessive green light in the emitted spectrum may appear. This may not be desirable. In other embodiments of the invention, other metal halides may also be present in small quantities.

In an embodiment of the invention, the high-intensity discharge lamp is such that for the light radiated during the life of the lamp the deviation in chromacity (d.u.v.) on the u-v chromacity coordinates (CIE 1931) is within the range of about −0.006–+0.010. In an embodiment of the invention, this range is between −0.003 and +0.007, the correlated color temperature is about 3500–5000K, the average color rendition index value (Ra) is about 75–95, and the luminous efficacy is about 95–130 lm/W.

In the embodiment described previously, it may be possible to obtain stable color characteristics throughout the life of the lamp, regardless of the positioning of the lamp, by arranging that the deviation in chromacity (d.u.v.) on the u-v chromacity coordinates (CIE 1931) is within the range of −0.006 to +0.010, or between −0.003 and +0.007. These stable color characteristics may also be obtained regardless of variations in the lamp voltage resulting from changes in lighting direction during the life of the lamp, such that a high-intensity discharge lamp which delivers a good balance between high efficiency, correlated color temperature and the average color rendition index value may be obtained.

Generally, when a lamp is filled with Na halide and rare earth halides and when the operating position is changed from vertical to horizontal, the emitted light in the red domain may spread due to the rise in temperature of the arc tube. In such a case, the correlated color temperature may decrease with the chromacity deviation (d.u.v.) moving in a negative direction. In the present invention, however, the lamp is configured to follow the Black Body Locus—BBL on the x-y chromacity coordinates (CIE 1931) due to the effect of the combination of Tm halide and In halide.

The light emission characteristics of a lamp are generally best in vertical use configuration (Base Up—BU, Base Down—BD) and generally worst for horizontal operation (Base Horizontal—BH). If the lamp is positioned diagonally, intermediate emission characteristics (between those for vertical operation (BU) and horizontal operation (BH)) may be obtained.

In an embodiment of the invention, the high-intensity discharge lamp is such that the pressure of the outer jacket within which said arc tube is disposed is less than about 133 Pa.

By keeping the interior of the outer jacket at a low pressure, convection generally does not occur inside the jacket, which enables the reduction in efficiency, due to a dramatic loss of temperature in the arc tube or blackening of the arc tube, to be avoided. Furthermore, it is also possible to control changes in the color temperature due to changes in the operating position.

In an embodiment of the invention, the high-intensity discharge lamp is such that the inner shroud tube which encloses the arc tube includes quartz glass whose spectral transmittance at 220–370 nm in the ultraviolet spectrum is about 60% or greater.

By surrounding the arc tube with an inner shroud tube of cylindrical or the like shape, including a translucent quartz glass tube or a ceramic tube, it may be possible to improve the luminous efficacy by raising the temperature of the interior of the arc tube and by raising the temperature of the coldest point which affects the emission properties. At the same time, it may also be possible to prevent fragments of the arc tube from flying when the arc tube is damaged.

By having the spectral transmittance of this inner shroud tube at about 220–370 nm in the ultraviolet spectrum, at about 60% or greater, with lamps using quartz glass opaque to ultraviolet light but with a translucence of around 92% for light in the visible spectrum at 380–780 nm, luminous efficacy can be raised by around 5–15% in comparison to a lamp using quartz glass opaque to ultraviolet light but with a translucence of around 91% in said visible spectrum even though there is only a difference of around 1% in the translucence in the visible spectrum.

In an embodiment of the invention, there is provided a lighting device including a lamp and a lighting circuit in which the lamp voltage waveform, when lit, is a rectangular waveform of 100 Hz–1 kHz. In this embodiment of the invention, the secondary open circuit voltage is about 150–400V.

In an embodiment of the invention, a rectangular waveform circuit or a stabilized lighting circuit employing a magnetic induction system with a choke coil or transformer can be used to make the high-pressure discharge lamp light.

In an embodiment of the present invention, if the lighting waveform of the high-pressure discharge lamp is made to light with a rectangular waveform in the 100 Hz–1 kHz range, it may be possible to obtain stable arc with no flicker. Moreover, where the secondary open voltage from the stabilizer lights in the range of about 150–400 V, the glow arc during initiation may proceed smoothly, and blackening of the arc tube due to spluttering of the electrodes can be controlled. It is also possible to prevent fading with changes in operating positioning during operation and within the lifetime of the lamp.

When the light has a wavelength of less than 100 Hz, flicker may occur in the arc during lighting. Moreover, when lighting is carried out at frequencies greater than about 1 kHz, there may be a reduction of the luminous flux throughout the course of the lighting. Flutter of the arc due to a vibrational phenomenon may also be created. In such a case, the lumen maintenance factor may severely be reduced.

If the secondary open voltage is lit between about 150–400V, and with a start-up at less than about 150V, a smooth transfer may not be made from the glow discharge to the arc discharge. With lighting in excess of about 400 V, the applied voltage to the electrodes may be too high and blackening of the arc tube may occur.

In an embodiment of the present invention, there is provided a lighting device including a high-intensity discharge lamp and a lighting circuit means which lights this high-intensity discharge lamp by dimming operation.

The lighting device may include parts such as the high-intensity discharge lamp, a lighting circuit device, a screen, a reflective mirror, a translucent cover and a lens.

The term 'dimming operation' as used herein means or refers to the adjustment of the electric power with respect to the power rating of the lamp. It should be understood that there is no particular restriction on the waveform of the lamp voltage and lamp current at this time.

In the present invention, the term "lighting device" as used herein refers to a device that encompasses all kinds of devices using the emission from a high-intensity discharge lamp for some purpose. For example, the lighting device may include spherical high-intensity discharge lamps, lighting equipment, vehicle headlights, light sources for optical fibers, image projection devices, optical equipment, fingerprinting devices and the like.

In an embodiment of the invention, there is provided a lamp wherein the end sections are tubular sections with given constant diameter. In another embodiment of the invention, the diameter of the central section of the lamp is constant.

In these embodiments, tubular sections with given constant diameter may provide stable color temperature because of uniform capillary distance, and a central section with given diameter may provide better lumen maintenance.

In an embodiment of the invention, there is provided a lamp, wherein the internal diameter of the central section is larger than the internal diameter of the end sections. In this case, higher luminous efficacy can be obtained.

In an embodiment of the invention, there is provided a lamp, wherein the central section is bulgy or ramp-like with increasing diameter including a most extended diameter. In this case, higher color rendition can be obtained.

In an embodiment of the invention, by sealing within an arc tube halides, which have as their main components metals such as Na, Tl, Tm and In in specified proportions by weight, various emission characteristics and electrical properties such as power rating, luminous efficacy, correlated color temperature, average color rendition index value (color rendering), chromatic deviation and life can be improved. In this embodiment, it may be possible to provide a high-intensity discharge lamp, such as a metal halide lamp, with improved quality, which delivers a stable white light which varies little in intensity regardless of the position in which the lamp is used to light.

In an embodiment of the present invention, the maximum variations, which are generated when changing from vertical operation to horizontal operation (including diagonal lighting), are within about +/−15% for electric power, about +/−15% for efficiency, less than about 10 points for average color rendition index value (color rendering) and less than about 0.0150 for chromatic deviation (d.u.v.) with reference to vertical operation. In such a case, a dramatic decrease in the degree of variation compared to conventional lamps of a similar type may be obtained.

It is thus possible to relax the restrictions on the operating position of the lamp (direction), allowing an expansion in the possible uses of the same type of lamp, and contributing to an improvement in productivity by reducing the need for different types of lamps.

In an embodiment of the present invention, convection may be prevented within the interior by adjusting the pressure within the outer jacket, thus avoiding loss of temperature in the arc tube. In this embodiment, the light emission properties are improved, and by raising the temperature of the arc tube within the inner shroud tube, thereby raising the temperature of the coldest point which affects the emission characteristics of the lamp, it may be possible to provide a high-intensity discharge lamp which has improved luminous efficacy.

In the present invention, it is possible to obtain a stable arc which does not flicker and the glow arc transfer during initiation is stable. It is also possible to suppress, in the present invention, blackening of the arc tube due to sputtering of the electrodes. Furthermore, during operation it may be possible, in particular, to prevent fading when changes are made to the lighting direction during the lifetime of the lamp.

In the present invention, there is no dramatic reduction in the efficiency of light emission of the lamp. In addition, in the present invention, the changes in value of the correlated color temperature are extremely small, and fading can be prevented.

BRIEF DESCRIPTION OF THE DRAWINGS

Embodiments of the invention will now be described with reference to the drawings.

FIGS. 8(*a*)–8(*c*) are vertical cross-sectional frontal views showing schematically one end of an arc tube having different structures;

DETAILED DESCRIPTION

Figure 1:
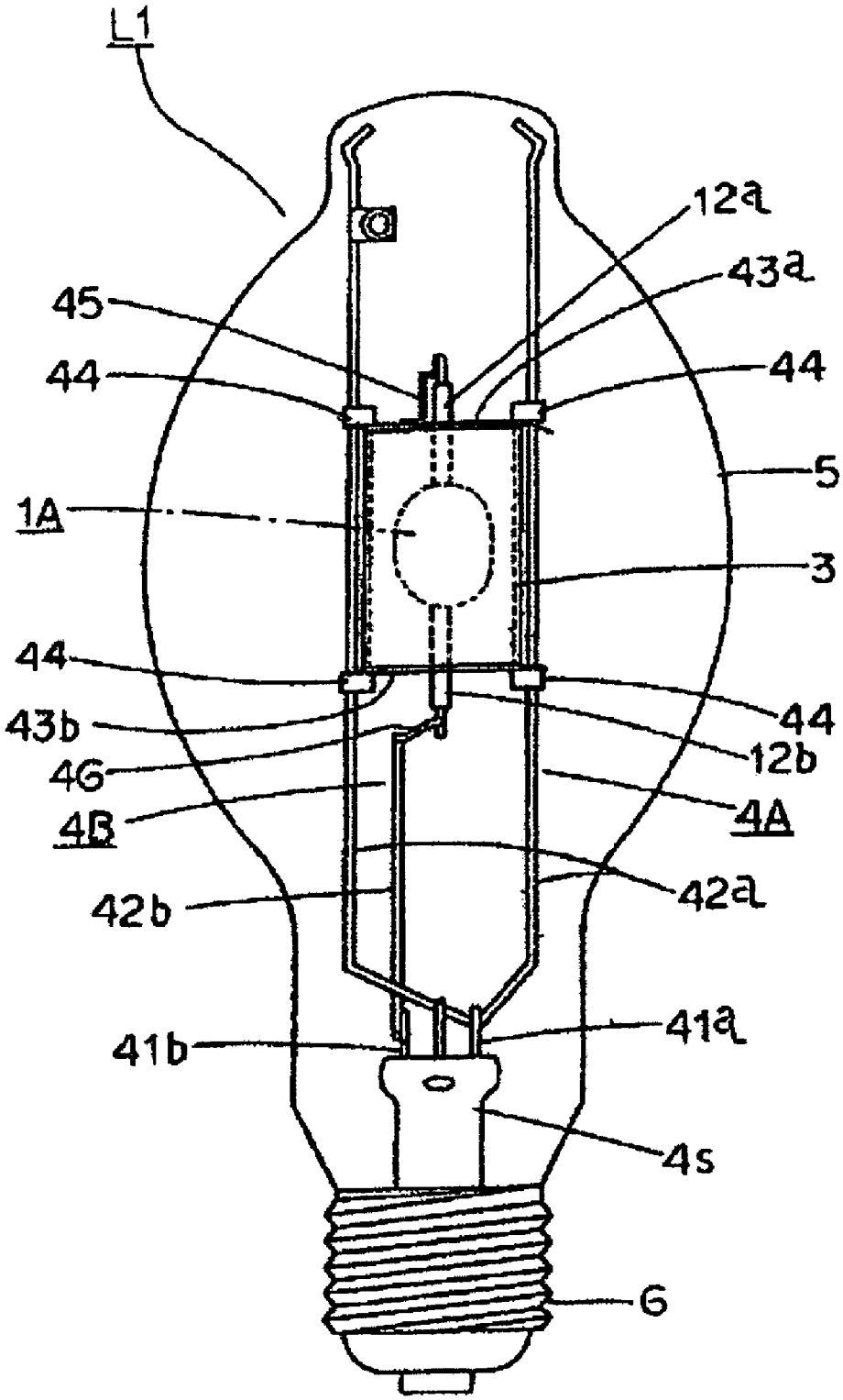
FIG. 1 shows a schematic frontal view of an embodiment of the high-intensity discharge lamp of the invention.

In FIG. 1, high-intensity discharge lamp L1 includes an arc tube 1A, an inner shroud tube 3, which surrounds arc tube 1A, an outer jacket 5 within which a pair of feeder members 4A, 4B is housed. The pair of feeder members 4A, 4B supply electricity in addition to supporting arc tube 1A and inner shroud tube 3. The high-intensity discharge lamp L1 further includes a screw base 6 provided at the end of the outer jacket 5.

Arc tube 1A includes a discharge chamber 1 made of a translucent ceramic material formed in a roughly spherical shape and tapering in a continuous curve at both ends of bulging section 11 to small-diameter tubular portions 12*a*, 12*b*. The chamber 1 has a vertically symmetrical structure in which linear electrical feed-throughs 23*a*, 23*b*, made of Nb, pass through the ends of small diameter tubular sections 12*a*, 12*b*. The linear electrical feed-throughs 23*a*, 23*b* are connected to electrodes 2A, 2B and are hermetically sealed with glass sealant 13.

Figure 2:
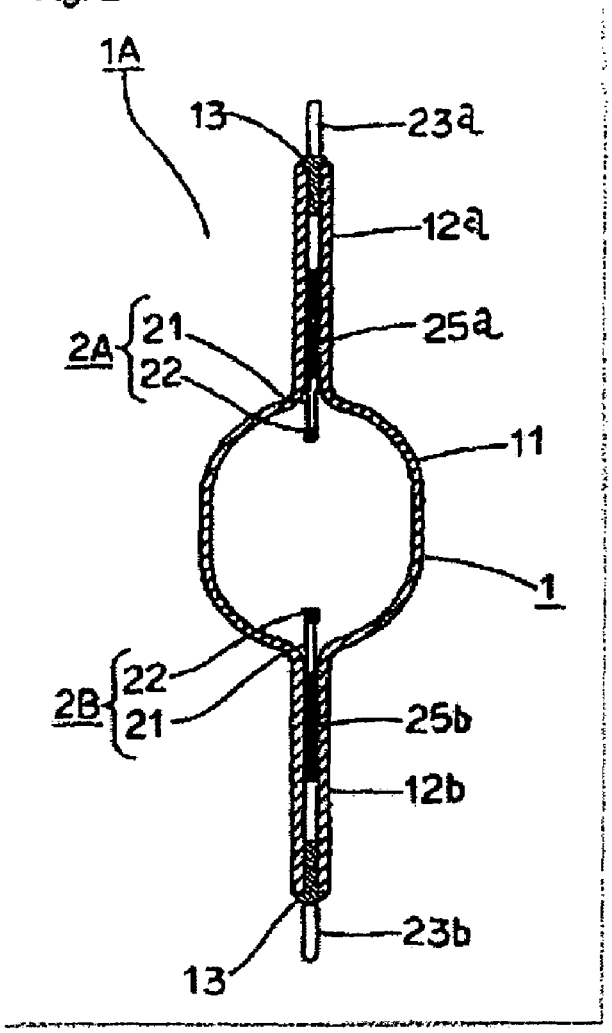
FIG. 2 is an expanded frontal cross-section showing the arc tube portion of FIG. 1, according to an embodiment of the invention.

In the embodiment of the invention represented in FIG. 2, electrodes 2A, 2B are welded to face one another through coiled sections 25*a*, 25*b* made of molybdenum wound around said electrical feed-throughs 23*a*, 23*b* and positioned within small diameter tubular sections 12*a*, 12*b*. Electrodes 2A and 2B include electrode shafts 21 at their tips, which have tungsten wire close to bulging section 11, and coiled sections 22 wound from fine tungsten wire on the tips of these electrode shafts 21.

The gap between the electrode shafts 21 passing through these small diameter tubular sections 12*a*, 12*b* and the internal walls of the these small diameter tubular sections 12*a*, 12*b* is less than 0.1 mm in an embodiment of the invention. Where the gap is large, the gap may be reduced by winding around the electrode shafts 21 a coil including fine wire of molybdenum or the like, and the external surface of this coil may be in contact with the inner surface of small diameter tubular sections 12*a*, 12*b*. The coil shaped electrode 22 on the tip of said electrode shafts 21 is not essential, and the tips of electrode shafts 21 may be of a substance which acts as an electrode.

In an embodiment of the invention, the discharge chamber 1 of the arc tube 1A is filled with a start-up or buffer gas including argon Ar as a discharge medium, a metal halide as an emission metal, and mercury.

This metal halide has a gross filling weight of Mmg (=MNamg+MTlmg+MTmmg+MInmg) including sodium iodide NaI, MNamg, thallium iodide ThI, MTlmg, indium iodide InI, MInmg, and thulium iodide $TmI_3$, MTmmg. (In cases where indium iodide InI is not included, the gross filling weight Mmg=MNamg+MTlmg+MTmmg).

In an embodiment of the invention, the relative weights of the other components are adjusted with respect to the gross filling weight M of the metal halides as follows: Tm halide at about 40–90 wt %, Tl halide at about 5–20 wt %, In halide at about 0.5–8 wt %, Na at less than about 40 wt %, with Ca, Cs, Li, Mg, Rb, Ce, Pr halides at less than about 10 wt %. Mercury is included in the mix at the proportion of about 3–25 mg/cc of the volume of discharge chamber 1.

The ratios of the filled weights of each of the halides at this time are as follows.

Their relative relationships are:

(1) The ratio by weight to the gross mass of the filled metal halides (Mmg)(=MNamg+MTlmg+MTmmg+MInmg) of $TmI_3$ (MTmmg) is MTm/M, about 0.4–0.9 (40–90%)

(2) The ratio by weight to the gross mass of the filled metal halides (Mmg) of $TmI_3$ (MTmmg) and TlI (MTlmg) is (MTm+MTl)/M, about 0.6–0.9 (60–90%)

(3) The ratio by weight to the gross mass of the filled metal halides (Mmg) of $TmI_3$ (MTmmg) and TlI (MTlmg) and InI (MInmg) is (MTm+MTl+MIn)/M, about 0.61–0.9 (61–90%), the ratio by weight to the gross mass of the filled metal halides (Mmg) of InI (MInmg) is MIn/M, about 0.01–0.1 (1–10%), (4) The ratio by weight to $TmI_3$ (MTmmg) and TlI (MTlmg) of InI (MInmg) is (MIn/MTm+MTl), less than about 0.1 (less than 10%), and moreover MIn/(MTm+MTl) $\leqq 0.1$ (5) Ca, Cs, Li, Mg, Rb, Ce, and Pr halides account for less than about 10 wt %.

In an embodiment of the invention, the high intensity lamp may be assembled as follows. One end of outer jacket 5, made of quartz glass or the like (the top end in the diagram), is closed off forming a BT shape. Next, a mount supporting the arc tube 1A is inserted from the opening at the other end (lower end). This opening is then heated using a burner to melt stem 4*s* of the mount, closing it to form a sealed section (not shown in the diagram). Outer jacket 5 may then be evacuated using a vacuum tube (not shown in the diagram) after the formation of a stopper section and its pressure may be reduced to a vacuum at about 133 Pa or less.

In the embodiment of the invention shown in FIG, 1, the pair of feeder members 4A, 4B include feeder lines 42*a*, 42*b*, which can be made of molybdenum wire or the like. These feeder lines extend into outer jacket 5 and are connected to one end of internal lead wires 41*a*, 41*b*. Lead wires 41*a* and 41*b* extend from the wires hermetically sealed into stem 4S of the mount. The external lead portion (not shown in the diagram) of wires 41*a* and 41*b*, which can be made of molybdenum wire or the like, extend into outer jacket 5 to connect with the other end, and support members 43*a*, 43*b* for inner shroud tube 3 and said arc tube 1A provided on one of feeder lines 42*a*.

The single feeder line 42*a* described above is arrayed so as to be elastically in contact with the internal wall of the head portion of outer jacket 5 whose tip comprises a BT shape. The feeder line 42*a* is extended and divided into parallel parts whose tips are separated and formed into an approximate V-shape. As can be seen in FIG. 1, support members 43*a*, 43*b* are formed in the central portion of these parallel feeder lines 42*a*. These support members may have a circular or rectangular shape and may be spaced apart such that a gap is defined between them. These supports may be structurally configured to hold feeder lines 42*a*, 42*b* firmly in position. In FIG. 1, feeder lines are attached to support members 43*a* and 43*b* via fixing members 44 with direct welding.

Arc tube 1A is held in place by having small diameter tubular sections 12*a*, 12*b* of discharge chamber 1 inserted through perforations formed in the center of separated circular support members 43*a*, 43*b* and also with fixed members 44 supporting inner shroud tube 3 between support members 43*a*, 43*b* so as to surround the arc tube 1A.

In the embodiment of the invention represented in FIG. 1, support member 43*a*, which is connected to one of feeder lines 42*a*, is connected to electrical feed-through 23*a* via conductor 45, and is connected to electrical feed-through 23*b* via conductor 46. Conductor 46 is connected to the tip of the other feeder line 42*b* which is extended and bent into an approximate L-shape.

Thus, the feeder line portions 42*a*, 42*b* of feeder members 4A, 4B, which extend into outer jacket 5, are connected electrically to electrical feed-throughs 23*a*, 23*b* at the ends of arc tube 1A in order to conduct electricity there, and are supported in position along the axis of arc tube 1A.

Depending on the quality and application of the lamp, the stopper section of the outer jacket 5, may be provided with a screw base 6 which functions as a cover, an external lead wire being connected to the terminal of this screw base 6 thus completing the structure of the metal halide lamp which includes high-intensity discharge lamp L1.

With screw base 6 mounted in a socket, when supplied with electricity from, for example, a 100 Hz–1 kHz rectangular wave lighting circuit device (not shown in the diagram), this discharge lamp L1 is configured to deliver a stable light as voltage is applied to terminals 2A, 2B via electrical feed-throughs 23*a*, 23*b* of arc tube 1A via feeder members 4A, 4B and screw base 6.

An aspect of the invention resides in the halides which are filled within the arc tube as light-emitting metals. In an embodiment of the invention, the performances of the lamp L1 may be maximized by using Na, Tl and Tm or Na, Tl, Tm and In halides and by controlling the proportion by weight of these materials.

For example, in an embodiment of the invention, the halides used are NaI—TlI—InI—$TmI_3$ whose relative proportions by weight are approximately 30 wt %: 15 wt %: 5 wt %: 55 wt %. When variations are made in the proportion of the weights of the various materials with respect to the gross filling weight Mmg of all these metal halides, the changes in the emission characteristics are as shown in FIGS. 3–7.

Figure 3:
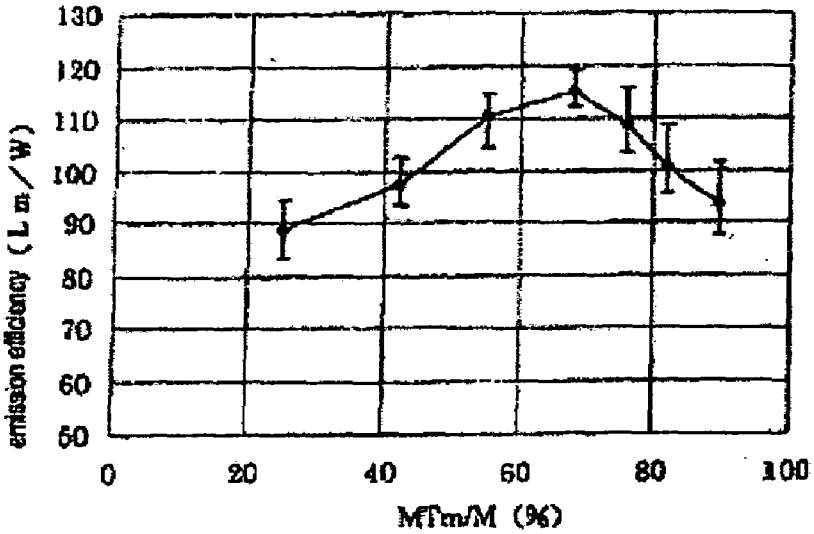
FIG. 3 is a graph representing the variation of the luminous efficacy Lm/W (y-axis) as a function of the ratio of the sealed mass Na, Tl and Tm in a lamp in which Tm is in excess of 93% with respect to the gross sealed mass of the metal halides, MTm/M (%) (x-axis)
Figure 4:
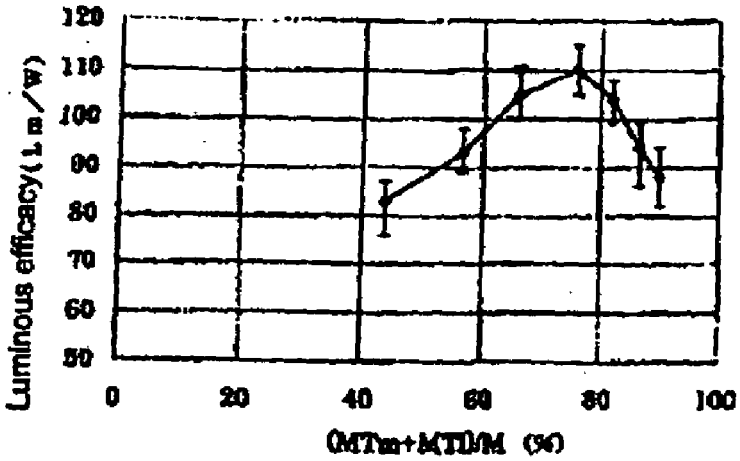
FIG. 4 is a graph representing the variation of luminous efficacy Lm/W (y-axis) as a function of the ratio of the sealed mass of $TmI_3$ (MTm) and TlI (MTl) with respect to the gross sealed mass (M) of metal halide in the arc tube (MTm+MTl)/M (%) (x-axis))

FIG. 3 is a graph showing the changes that occur when the proportion (%) of the filling weight of $TmI_3$ (MTm) in a lamp containing this halide in excess of 93% is varied with respect to the gross filling weight of metal halides Na, Tl and Tm. In this graph, the x-axis shows the ratio by weight of MTm/M (%) and the y-axis represents the luminous efficacy Lm/W. With a correlated color temperature of about 3500K–5000K and an average color rendition index value Ra in the range of about 75–95, where the ratio by weight of MTm/M (%) is about 0.35–0.9 (35–90%), efficiency is about 95 Lm/W or greater, the correlated color temperature is about 3500K or more, and the average color rendition index value is about 75 or better. Where the ratio by weight (%) is about 0.55–0.75 (55–75%), efficiency is about 100

Lm/W or greater, the correlated color temperature is about 4000K or more, and the lamp is obtained with the desired average color rendition index value.

Figure 5:
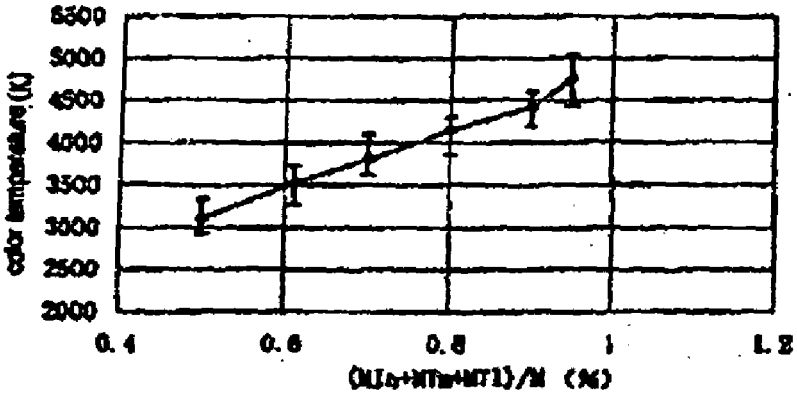
FIG. 5 is a graph representing the variation of the chromaticity as a function of the proportion (%) of the sealed mass of some halides.

FIG. 5 is a graph showing the changes when the proportion (%) of the filling weight of $TmI_3$ (MTm), TlI (MTl) and InI (MIn) is varied. In this graph, the x-axis shows the ratio by weight of (MTm+MTl+MIn)/M and the y-axis represents the chromacity. While the correlated color temperature is in the range of about 3500–5000K where the ratio by weight of (MTm+MTl+MIn)/M (%) is about 0.6–0.9 (60–90%), when the ratio drops below 0.6 (60%) or exceeds 0.9 (90%) the luminous efficacy may drop below 95 Lm/W.

Figure 6:
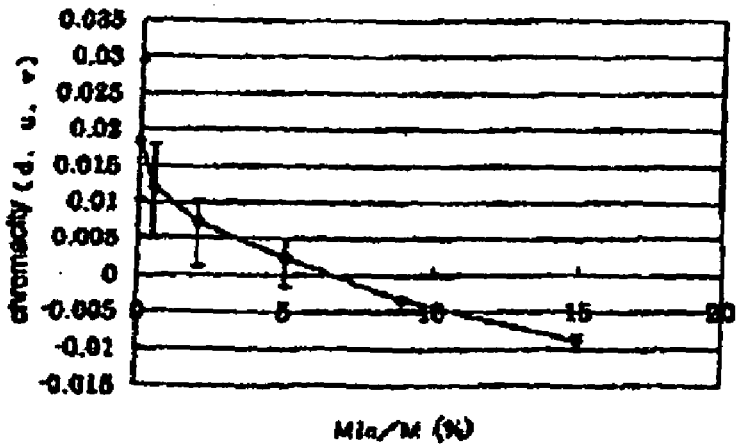
FIG. 6 is a graph representing the variation of the chromaticity as a function of the proportion (%) of the sealed mass of InI.

FIG. 6 is a graph showing variations in the proportion (%) of the filling weight of InI (MIn). In this graph, the x-axis shows the ratio by weight of MIn/M (%) and the y-axis represents the deviation in chromacity (d.u.v.). Where the ratio by weight of MIn/M (%) is about 0.02–0.09 (2–9%) the deviation in chromacity (d.u.v.) is in the range −0.005–0.01, delivering a quality of emitted light that is close to white light.

Figure 7:
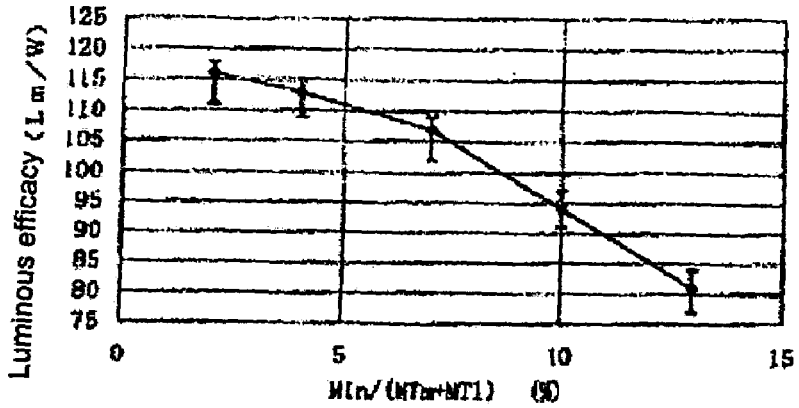
FIG. 7 is a graph representing the variation of the luminous efficacy as a function of the proportion (%) of the sealed mass of $TmI_3$ (MTm), TlI (MTl) and InI (MIn)

FIG. 7 is a graph showing variations in the proportion (%) of the filling weight of TmI3 (MTm), TlI (MTl) and InI (MIn). In this graph, the x-axis shows the ratio by weight of MIn/(MTm+MTl), and the y-axis represents the luminous efficacy. Where the ratio by weight of MIn/(MTm+MTl) drops below 0.1 (1%), an luminous efficacy of 95 Lm/W or more may be obtained.

In an embodiment of the invention, the metal halides that are used with the discharge lamp L1, are NaI, TlI, In and $TmI_3$. These metal halides have a radiated spectrum including mainly NaI in the red domain, mainly TlI in the green domain, and mainly InI in the blue domain, with $TmI_3$ mainly in the blue domain, thus providing a high-quality lamp L1 with emission characteristics of excellent value having a luminous efficacy of about 95–130 Lm/W, a correlated color temperature of about 3500–5000K, and an average color rendition index value (Ra) in the range of about 75–95.

Experiments have confirmed that by adjusting the filling weight by weight of $TmI_3$ and the like with respect to the gross filling weight M(Mg)(=MNamg+MTlmg+MTmmg+MInmg), it may be possible to provide a high-intensity discharge lamp L1 which can deliver white radiated light with good color rendition and no deterioration in luminous efficacy.

Furthermore, experiments have confirmed that by adjusting to about 0–0.15 the ratio by weight $InI/TmI_3$ of InI to $TmI_3$ among the light emitting metals, it may be possible to provide a high-intensity discharge lamp L1 which can deliver white radiated light with good color rendition and no deterioration in luminous efficacy.

Furthermore, it has been confirmed that by adjusting the ratio by weight $InI/TmI_3$ of InI with respect to $TmI_3$ and holding the ratio by weight $InI/TmI_3$ of InI with respect to $TmI_3$ within the range of about 0.05–0.5, it may be possible to deliver a high-intensity discharge lamp L1 which radiates a superior quality of white light with a good color balance having red, green and blue positioned on coordinates very close to the Black Body Locus (BBL) on the chromacity coordinates.

Figure 8:
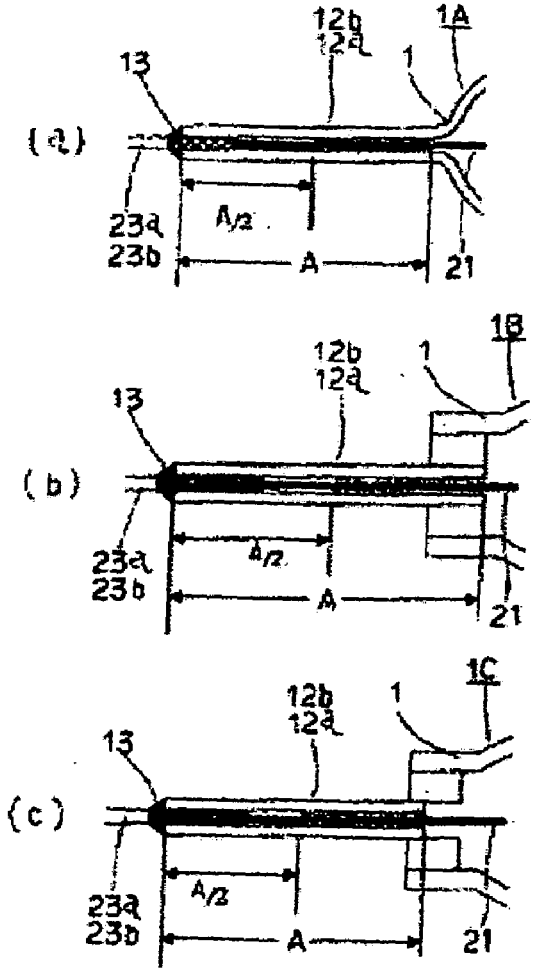
FIG. 8 shows the emission chamber according to an embodiment of the invention.

In an embodiment of the present invention, the emission chamber 1 has a structure as shown in FIG. 8(*a*). As can be seen in this figure, small-diameter tubular portions 12*a*, (12*b*), which taper in a continuous curve from both ends of bulging section 11 formed from the roughly spherical shape of arc tube 1A, are formed integrally. As can be seen in FIGS. 8(*b*), (*c*), discharge chamber 1, which forms the arc tube, may also have a different structure for the small diameter tubular sections 12*a*, (12*b*).

FIGS. 8(*a*)–(*c*) are schematic vertical cross-sections showing various structures of one end of the arc tube (the other end having a symmetrical structure and being here omitted). In these Figures, the descriptions of the parts identical to those shown in FIG. 2 have been omitted.

With arc tubes 1B, 1C shown in FIGS. 8(*b*), (*c*), bulging section 11 and small diameter tubular sections 12*a*, 12*b* are formed separately from translucent ceramic material, with small diameter tubular sections 12*a* (12*b*) being inserted through opening 11*a* at both ends of bulging section 11 and sealed hermetically with a glass adhesive 14, being generally sealed with a method known as shrink-fitting. The difference between parts (b) and (c) of the figure resides in the different positions of the sealed small diameter tubular sections 12*a* (12*b*).

The halogen element chosen for the halide in the above embodiments is iodine I,. However, it should be understood that other halides such as bromine Br, chlorine Cl, and fluorine Fl may also be used, and a combination of different halogen elements may also be used.

Figure 9:
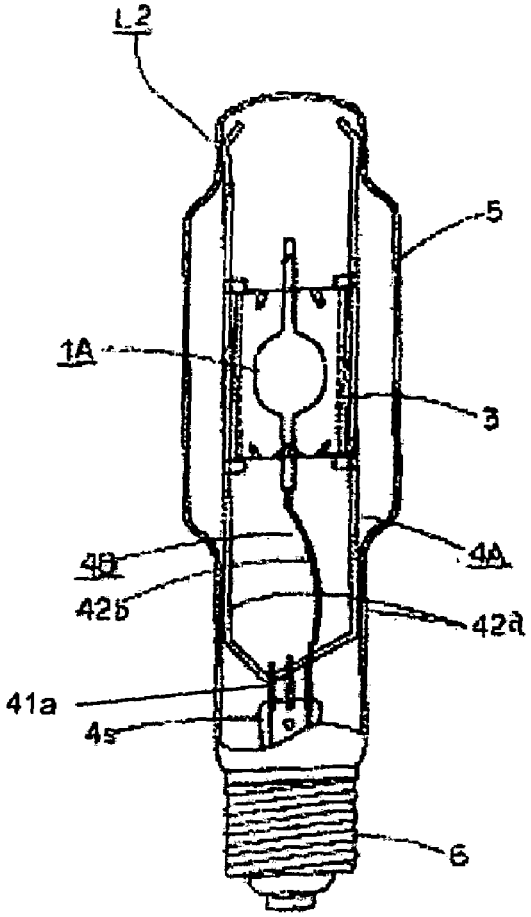
FIGS. 9 and 10 are frontal views of lamps according to several embodiments of the invention.
Figure 10:
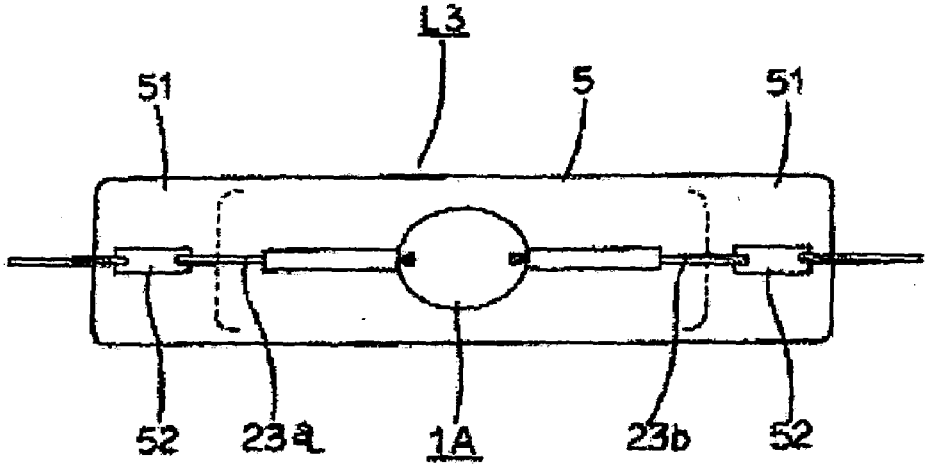

FIGS. 9 and 10 are frontal views showing separate embodiments of high-intensity discharge lamps L2, L3 of the invention. In these Figures, the descriptions of the parts identical to those shown in FIGS. 1 and 2 have been omitted.

In the embodiment of the invention shown in FIG. 9, the high-intensity discharge lamp L2 has a standard rating for the lamp of between about 280–440 W, and at 400 watts for example, outer jacket 5 housing arc tube 1A shown in FIG. 2 has a T-shape (straight tube) with the stem 4*s* of a mount sealed into a sealed portion (not shown in the drawing) at one end in the same way as in FIG. 1, with arc tube 1A being connected to and supported by feeder lines 42*a*, 42*b* of a pair of feeder members 4A, 4B provided in stem 4*s*.

In the embodiment of the invention shown in FIG. 9, outer jacket 5 has a coefficient of thermal expansion in the range of about $35\times10^{-7}$/° C.–$60\times10^{-7}$/° C. Outer jacket 5 is formed to a maximum external diameter of approximately 65 mm and a total length of approximately 250 mm from hardened glass with a distortion point of 500° C. or less. Outer jacket 5 houses an arc tube 1A which has a discharge chamber 1 having a maximum external diameter of about 22 mm and a total length of approximately 80 mm made of translucent ceramic having a shape similar to that of the above embodiments. It should be understood that shroud tube 3, provided to surround arc tube 1A, is not essential. However, if this tube is arranged in the lamp, it may be desirable that the gap between the shroud tube and the outer surface of arc tube 1A be about 2 mm or more.

In the embodiment represented in FIG. 9, the emission characteristics are similar to those of lamp L1 as discussed in the above embodiments. In an embodiment of the invention, lamp L2 not only provides the desired emission characteristics, but is configured to reduce the surface temperature of outer jacket 5 when functioning in lighting equipment. In such a case, both lamp L2 itself and the lighting equipment that houses it, may be made more compact.

Furthermore, in case that lamp L2 uses a T-shaped outer jacket 5 as shown in FIG. 5, by ensuring that the relationship between the maximum external diameter DO of outer jacket 5 and the maximum external diameter DI of the discharge chamber 1 and the standard rating W of the lamp are kept within the range of the relationship shown below, it may be possible to improve the luminous efficacy, correlated color temperature and average color rendition index values (Ra)

by maintaining a suitable temperature for arc tube 1A when lamp L2 is lit. It may also be possible to prevent breakage of discharge chamber 1.

In an embodiment of the invention, the external diameter of the outer jacket 5 and the maximum external diameter DI of the discharge chamber 1 satisfy the following equation:

$$(DO-DI)/2W=0.05-0.087$$

When the value falls below 0.05 in the above formula, outer jacket 5 is exposed to an excessive rise in temperature due to the fact that the gap between discharge chamber 1 and outer jacket 5 has become too narrow and close together, with the danger of breaking outer jacket 5 or causing leaks from arc tube 1A. Moreover, when the value exceeds 0.087, arc tube 1A may be subject to a reduction in temperature due to the fact that the gap between discharge chamber 1 and outer jacket 5 is too great, with the danger that the desired emission characteristics may not be obtained.

With high-intensity discharge lamp L3 shown in FIG. 10, outer jacket 5 which houses arc tube 1A shown in FIG. 2 is formed of T-shaped (straight tube) quartz glass, and has a structure provided with pressure seals 51 within which are sealed molybdenum strips 52. In the embodiment of the invention shown in FIG. 10, strips 52 are connected to electrical feed-throughs 23*a*, 23*b* which lead out from both ends of arc tube 1A, with the effect that the various emission characteristics are identical to those of lamp L1 in the above embodiments.

Figure 11:
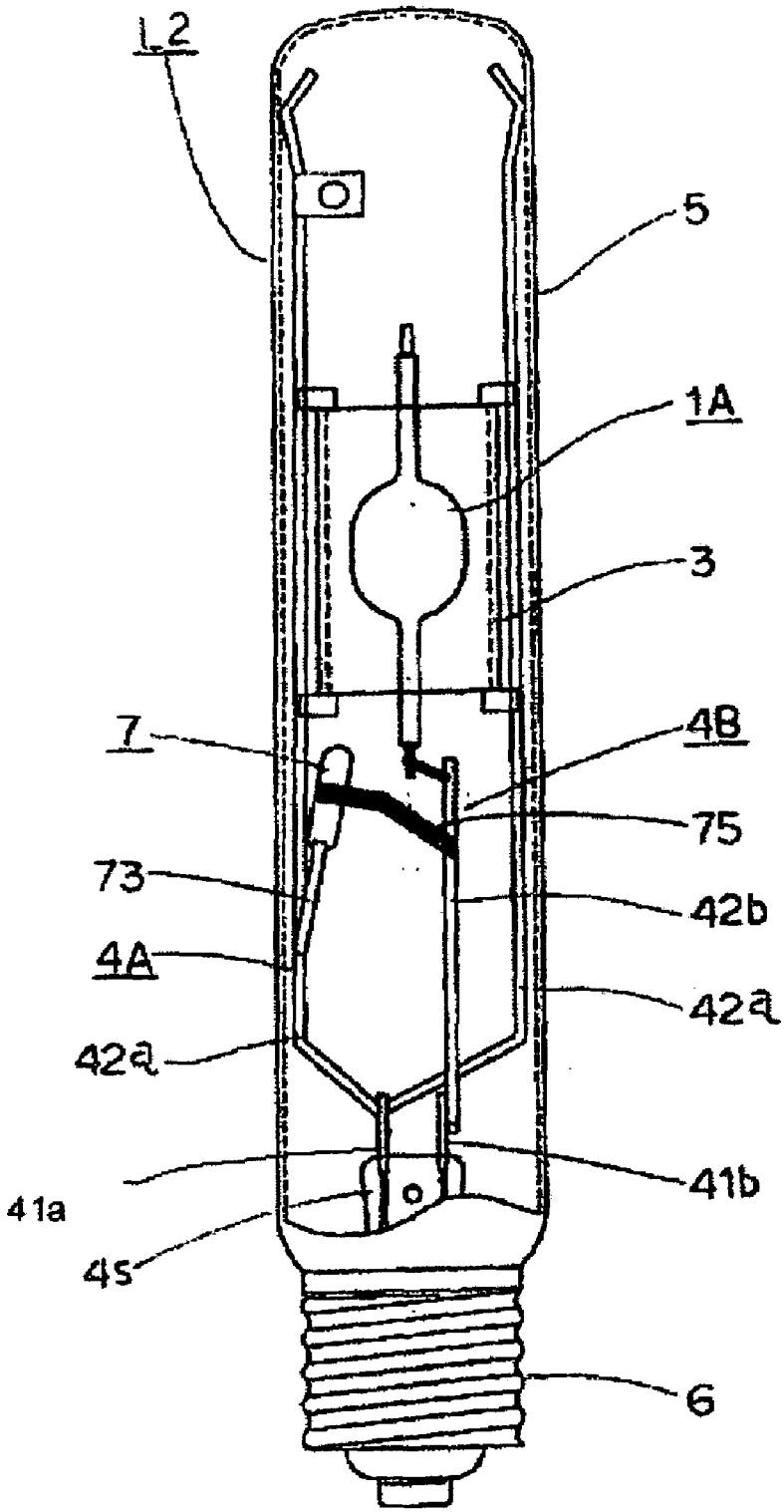
FIG. 11 is a schematic frontal view of a further embodiment of a discharge lamp.

The high-intensity discharge lamp L4 of the embodiment of the invention shown in FIG. 11 has a standard rating for the lamp of between about 280–440 W, and at 250 W for example, outer jacket 5 housing arc tube 1A shown in FIG. 2 is a T-shape (straight tube) with the stem 4*s* of a mount sealed into a sealed portion (not shown in the drawing) at one end in the same way as in FIG. 1. In FIG. 11, arc tube 1A is supported by feeder line 42*a*, which overlaps with feeder members 4A, 4B connected to internal lead wires 41*a*, 41*b* of stem 4*s*, and by feeder line 42*b*.

In an embodiment of the invention, the outer jacket 5 is formed to a maximum external diameter of approximately 65 mm and a total length of approximately 250 mm from hardened glass. Outer jacket 5 houses arc tube 1A which has a discharge chamber having a maximum external diameter of about 16 mm and a total length of approximately 60 mm made of translucent ceramic having the same shape as those in the embodiments discussed above. It should be understood that shroud tube 3 provided to surround arc tube 1A is not essential. However, if shroud tube 3 is provided, it may be desirable that the gap between shroud tube 3 and the outer surface of arc tube 1A be about 2 mm or more. As can be seen in FIG. 11, lamp L2 further includes an ultraviolet source 7, which is connected to and supported by feeder lines 42*a*, 42*b*. Source 7 is provided within outer jacket 5 in a position close to arc tube 1A.

Figure 12:
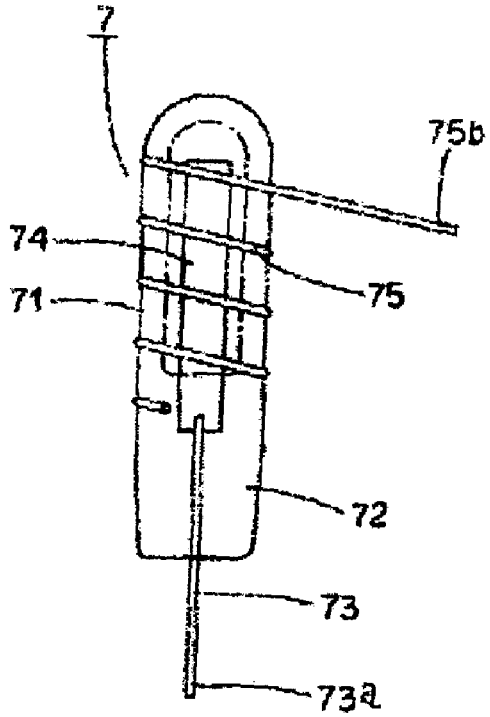
FIG. 12 is an expanded frontal view of an UV radiation source according to an embodiment of the invention.

In an embodiment of the invention, this ultraviolet source 7, as shown in expanded form in FIG. 12, is connected to electrode 74, formed with an internal conductor member inside sealed chamber 71 in strip form having a width of approximately 1.5 mm, a thickness of approximately 30 microns and a length of approximately 8 mm, with lead wire 73 doubling as a sealing wire of molybdenum wire having an external diameter of about 0.75 mm and hermetically sealed within stopper section 72 formed in the end section of sealed chamber 71. In an embodiment of the invention, sealed chamber 71 is translucent to ultraviolet light and includes quartz glass in an approximately cylindrical shape having an external diameter of about 4 mm, and internal diameter of about 2 mm and a length of about 20 mm. In an embodiment of the invention, a noble gas such as argon is filled into this sealed chamber 71 at a pressure of approximately 1300 Pa.

Around the circumference of this sealed chamber 71, which is translucent to ultraviolet light, is wound external conductor member 75 including, for example, 0.4 mm iron-nickel alloy with about four spiral turns (the state of the winding is not shown in FIG. 8). One end 75*b* of this external conductor member 75 and the other end 73*a*, which extends from stopper 72 of lead wire 73 and which also functions as a sealing wire, are connected respectively to feeder lines 42*a*, 42*b*.

Internal conductor member 74 and external conductor member 75 of the ultraviolet emission source 7 are welded together and the capacitance that is formed is approximately 0.5 pF.

High-intensity discharge lamp L4 of the above structure is connected to the socket of a lighting circuit device, which includes a stabilizer or the like (not shown in diagram), with screw base 6.

With discharge lamp L2 connected to this lighting circuit device, during start-up, a high-intensity pulse is applied to external conductor member 75 and lead wire 73 of ultraviolet source 7 connected in parallel to feeder lines 42*a*, 42*b* and electrodes 2A, 2B within arc tube 1A via feeder lines 42*a*, 42*b* overlapping with feeder members 4A, 4B via internal lead wires 41*a*, 41*b* connected electrically to screw base 6.

By applying this high-intensity pulse, a discharge break occurs between external conductor member 75 and internal conductor member 74 of ultraviolet source 7 with its small gap in capacitance bonding.

In other words, a discharge occurs between external conductor member 75 and electrode 74, which forms the internal conductor member of ultraviolet source 7 which has a low impedance compared to that between electrodes 2A, 2B within arc tube 1A. Due to this discharge, ultraviolet rays may be generated within sealed chamber 71 which is translucent to ultraviolet light. The ultraviolet light may also be radiated externally through the sealed chamber 71.

In the present invention, as a result of ultraviolet light being radiated towards terminals 2A, 2B within arc tube 1A from ultraviolet source 7 positioned close to arc tube 1A, a discharge may be promoted between said electrodes 2A, 2B. In this configuration, the arc tube 1A may be started up easily in an extremely short time of approximately one second, and it may be possible to maintain a stabilized light thereafter.

It should be noted that if the capacitance formed between internal conductor member 74 and external conductor member 75 of ultraviolet source 7 is approximately 0.5 pF, the impedance component may be reduced. Therefore, when a high-intensity pulse is generated a greater degree of current leakage will flow. This allows the amount of ultraviolet light radiated to increase, thus making start-up easy.

Thus, even when the structure of the shape of outer jacket 5 is varied in this way, it is possible to obtain emission characteristics similar to those of lamp L1 as discussed in the above embodiments. In this embodiment of the invention, both lamp L4 itself and the lighting equipment that houses lamp 4 may be made more compact.

The start-up characteristics of lamps with filled halides, such as metal halide lamps, are generally not optimum because of the shortage of initialized electrons due to the atomic absorption effect of the halogen. However, when a start-up support device such as the ultraviolet source 7 is added, the start-up characteristics of the lamp may be improved.

Figure 13:
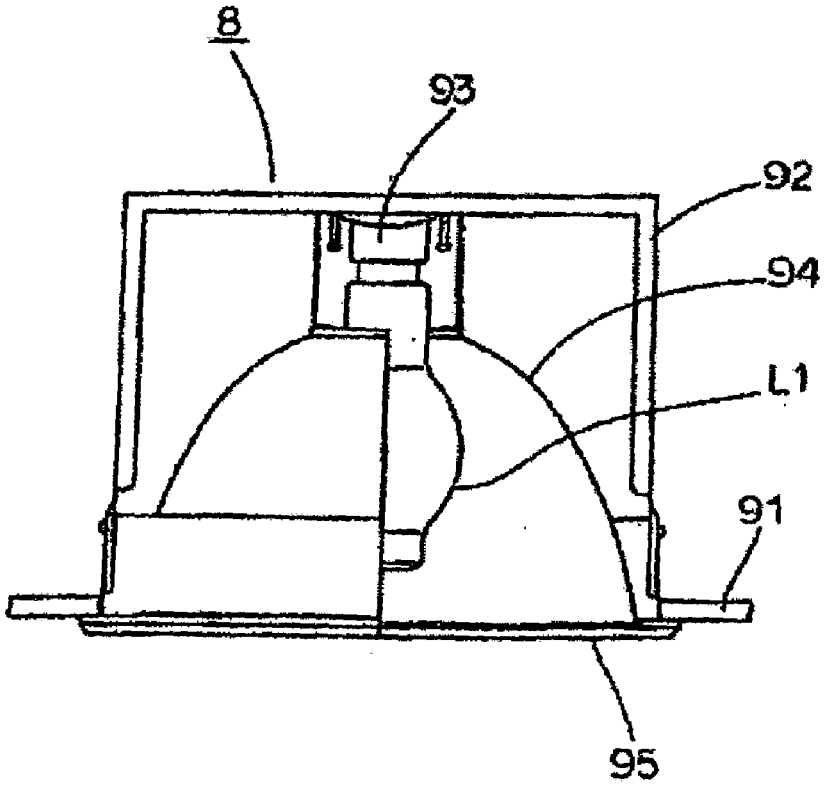
FIG. 13 is a frontal view in partial cross-section showing a lighting device, according to an embodiment of the invention.

FIG. 13 is a partial cross-section in frontal view showing lighting device 8 according to an embodiment of the invention employing the high-intensity discharge lamp L1. This lighting device 8 is a built-in lighting device which is installed into ceiling 91. Lighting device 8 has a main body 92 fixed to sealing 91, with the screw base 6 of high-intensity discharge lamp L1. Lamp L1 is mounted in socket 93 provided within the body 92 of the equipment (device). The main body 92 of the equipment (device) is fitted with a reflective mirror 94 which is configured to reflect the light radiated from lamp L1 in a downward direction, a cover member of glass or the like which covers the opening to this reflective mirror 94, and a focusing device 95 such as a lens or the like.

The high-intensity discharge lamp L1 is electrically connected to a lighting device having a stabilizer positioned separately to the main body 92 or the main body 92 of the equipment (device). The discharge lamp L1 can be lit by the electricity supplied by this lighting device.

It should be understood that the invention is not limited to the above embodiments. It should be noted, for example, that the arc tube, in addition to being made of a translucent ceramic material, may also be made of glass quartz where a halide with low corrosion properties is used and the tube wall loading is small.

Furthermore, it should be understood that the lighting device described herein is not limited to the above embodiments and may be a device having a different structure and application. In addition, it should be noted that the lighting system described herein is not limited to a rectangular wave lighting circuit device, and may also employ a stabilizer with a magnetic induction system such as a choke coil or a transformer.

Embodiments of the invention will now be described together with comparative examples (conventional models).

(Embodiment 1)

Embodiment 1 represents a high-intensity discharge lamp having the same structure as that shown in FIG. 1 and FIG. 2. Embodiment 1 is an integrally formed discharge chamber having a structure identical to arc tube 1A shown in FIG. 8(*a*).

A high-intensity discharge lamp with a structure identical to that shown in FIG. 1 and FIG. 2 was manufactured according to the specifications below, and the various emission characteristics were measured.

The power rating of the lamp was about 250 W, the arc tube 1A made of translucent alumina ceramic had a total length of approximately 60 mm, with an external diameter of bulging section 11 being approximately 16.6 mm, an internal diameter of approximately 14.0 mm and an internal volume of about 1.5 cc, and a tube wall loading of 28 watts/cm$^2$. In Embodiment 1, the external diameter of small diameter tubular sections 12*a*, 12*b* is approximately 3.0 mm, the internal diameter is approximately 1.2 mm, with the chamber 1 of this arc tube 1A being almost entirely surrounded by inner shroud tube 3.

Electrodes 2A, 2B have electrode shafts 21 of tungsten with an external diameter of approximately 0.6 mm and a length of approximately 8 mm, with the electrode coil section 22 wound from tungsten wire with an external diameter of approximately 0.2 mm, at a pitch density of approximately three turns, the distance of the gap between the two electrodes being approximately 15 mm.

Electrical conductors 23*a*, 23*b* are made of Nb and have an external diameter of approximately 0.9 mm, and a length of approximately 12 mm. In Embodiment 1, the coil sections 25*a*, 25*b* are wound from molybdenum wire with an external diameter of approximately 0.9 mm, and a length of approximately 12 mm.

The filled discharge medium includes argon as the start-up or buffer gas at approximately 53 kPa, with 10 mg of a combination of NaI—TlI—InI—$TmI_3$ as the halide in the proportions of approximately 30 wt %-15 wt %-5 wt %-50 wt %, and approximately 13 mg of mercury Hg.

(1) The ratio by weight of $TmI_3$ (MTmmg) to the gross mass of the sealed metal halides (Mmg)(Mmg=MNamg+MTlmg+MTmmg+MInmg) is MTm/M, which is approximately 0.5 (about 50%), (2) the ratio by weight of the sum of $TmI_3$ (MTmmg) and TlI (MTlmg) to the gross mass of the sealed metal halides (Mmg) is (MTm+MTl)/M, which is approximately 0.65 (about 65%), (3) the ratio by weight of the sum of $TmI_3$ (MTmmg) and TlI (MTlmg) and InI (MInmg) to the gross mass of the sealed metal halides (Mmg) is (MTm+MTl+MIn)/M), which is approximately 0.7 (about 70%), (4) The ratio by weight of InI (MInmg) to the sum of $TmI_3$ (MTmmg) and TlI (MTlmg) is (MIn/MTm+MTl), which is approximately 0.08 (about the 8%), in each case being within the restrictive range of values of the invention.

Outer jacket 5 has a BT shape and was made of hardened glass, with a maximum external diameter of about 116 mm, a maximum internal dimension of about 114 mm (a wall thickness of approximately 1.0 mm), an overall length of about 250 mm (an overall length of approximately 250 mm including the screw base 6), with the internal vacuum being approximately 100 Pa.

In Embodiment 2, the discharge chamber 1 is a shrink-fit type chamber having an identical structure to that shown for arc tube 1A in FIG. 8(*b*), and was manufactured according to the specifications below. Similarly to Embodiment 1, various emission characteristics were measured.

The power rating of the lamp was 250 W, the rated life was 12,000 hours, the arc tube 1A was made of translucent alumina ceramic having a total length of approximately 60 mm, with an external diameter of bulging section 11 of approximately 16.6 mm, an internal diameter approximately 14.0 mm and internal volume of 1.5 cc. In Embodiment 2, the external diameter of small diameter tubular sections 12*a*, 12*b* is approximately 3.0 mm, the internal diameter is approximately 1.2 mm, the total length is approximately 20 mm, and the chamber 1 of the arc tube 1A is almost entirely surrounded by inner shroud tube 6.

Electrodes 2A, 2B have electrode shafts 21 made of tungsten with an external diameter of approximately 0.6 mm and a length of approximately 8 mm. In Embodiment 2, electrode coil section 22 is wound from tungsten wire with an external diameter of approximately 0.2 mm, at a pitch density of approximately three turns, the distance of the gap between the two electrodes being approximately 15 mm.

Electrical conductors 23*a*, 23*b* are made of Nb and have an external diameter of approximately 0.9 mm, a length of approximately 12 mm, the coil sections 25*a*, 25*b* being wound from molybdenum wire with an external diameter of approximately 0.9 mm, and a length of approximately 12 mm.

The filled discharge medium includes argon as the start-up or buffer gas at approximately 53 kPa, with 10 mg of a combination of NaI—TlI—InI—$TmI_3$ as the halide in the proportions of approximately 30 wt %-15 wt %-5 wt %-50 wt %, and approximately 13 mg of mercury Hg.

Outer jacket 5 has a BT shape and was made of hardened glass, with a maximum external diameter of about 116 mm, a maximum internal dimension of about 114 mm (a wall thickness of approximately 1.0 mm) and an overall length of about 250 mm (an overall length of approximately 250 mm including the screw base 6).

By way of comparison to discharge lamp L1, (in Embodiment 1,2) discharge lamps were constructed having an identical structure in terms of dimensions and materials with the exception of the specifications for the halides. In Table 2, Comparative Example 1 has metal halides identical to those in Patent Reference 1, and corresponds to a lamp filled with sodium iodide NaI, thallium iodide TlI and dysprosium iodide DyI3 in the approximate proportions 30 wt %-15 wt %-55 wt %. Comparative Example 2 includes halides conventionally used in lamps, and corresponds to a lamp filled with sodium iodide NaI, thallium iodide TlI and cerium iodide CeI3 in the approximate proportions 30 wt %-15 wt %-55 wt %. Comparative Example 3 corresponds to a lamp filled with sodium iodide NaI, thallium iodide TlI and thulium iodide $TmI_3$ in the approximate proportions 30 wt %-15 wt %-55 wt %. Finally, Comparative Example 4 corresponds to a lamp filled with sodium iodide NaI, thallium iodide TlI, dysprosium iodide DyI3, holmium iodide HoI and thulium iodide $TmI_3$ in the approximate proportions 30 wt %-10 wt %-20 wt %-20 wt %-20 wt %.

The tables show the average values measured for the various emission characteristics for both vertical (BU) lighting and horizontal (BH) lighting with 10 lamps. Measurements were made after the lamps had been lit for 100 hours. Table 1 relates to each type of lamp in the inventions described above and to be described in Embodiments 1 through 3. Table 2 relates to the existing types of lamps described above and to be described in Comparative Examples 1 through 4.

TABLE 1

| | Embodiment 1 | | Embodiment 2 | | Embodiment 3 | |
|---|---|---|---|---|---|---|
| Type of arc tube | Integral type | | Shrink-fit type | | Integral type | |
| Halide used (% by weight) | Na, TlI, InI, $TmI_3$ (30:15:5:50 wt %) | | Na, TlI, InI, $TmI_3$ (30:15:5:50 wt %) | | Na, TlI, InI, $TmI_3$ (30:15:5:50 wt %) | |
| Lighting direction | Vert. BU | Horiz. BH | Vert. BU | Horiz. BH | Vert. BU | Horiz. BH |
| Lamp voltage (V) | 102.6 | 104.9 | 100.5 | 109.3 | 101.9 | 105 |
| Lamp wattage (W) | 246 | 243 | 247 | 244 | 400 | 3.97 |
| Total lumen (Lm) | 26986 | 26074 | 26009 | 24623 | 43281 | 40994 |
| Efficacy (Lm/W) | 110 | 107 | 105 | 101 | 108 | 103 |
| CCT(K) | 4188 | 4093 | 4276 | 4119 | 4238 | 4137 |
| Chromacity (d.u.v.) | 0.0026 | 0.0013 | 0.0072 | 0.0049 | 0.0028 | 0.0009 |
| Color rendition Ra | 82.1 | 84.6 | 80.1 | 85.1 | 81.5 | 82.2 |
| 1 | | | | | | |
| Total Lm | 912 | | 1386 | | 2287 | |
| CCR (K) | 95 | | 157 | | 101 | |
| Chromacity d.u.v. | 0.0013 | | 0.0023 | | 0.0019 | |
| Color rendition Ra | 2.5 | | 5 | | 0.7 | |
| 2 | | | | | | |
| MTm/M | 0.50 (50%) | | 0.50 (50%) | | 0.50 (50%) | |
| (MTm + MTl)/M | 0.65 (65%) | | 0.65 (65%) | | 0.65 (65%) | |
| (MTm + MTl + MIn)/M | 0.70 (70%) | | 0.70 (70%) | | 0.70 (70%) | |
| MIn/M | 0.05 (5%) | | 0.05 (5%) | | 0.05 (5%) | |
| MIn/ (MTm + MTl) | 0.08 (8%) | | 0.08 (8%) | | 0.08 (8%) | |

Key to Table 1:
1 = Amount of change
2 = Relationship between halides

TABLE 2

| | Comparative Example 1 | Comparative Example 2 | Comparative Example 3 | Comparative Example 4 |
|---|---|---|---|---|
| Type of arc tube | Integral type | Integral type | Integral type | Integral type |
| Halide used (% by weight) | Na, TlI, $DyI_3$ (30:15:55 wt %) | Na, TlI, $CeI_3$ (30:15:55 wt %) | Na, TlI, $TmI_3$ (30:15:55 wt %) | Na, TlI, $DyI_3$ $HoI_3$ $TmI_3$ (30:10:20:20:20 wt %) |

TABLE 2-continued

| | Comparative Example 1 | | Comparative Example 2 | | Comparative Example 3 | | Comparative Example 4 | |
|---|---|---|---|---|---|---|---|---|
| Lighting direction | Vert. BU | Horiz. BH | Vert. BU | Horiz. BH | Horiz. BH | Vert. BU | Horiz. BH | Vert. BU |
| Lamp voltage (V) | 102.6 | 113.5 | 101.4 | 114.9 | 100.4 | 106.3 | 102.2 | 110.4 |
| Lamp wattage (W) | 250 | 243 | 250 | 239 | 250 | 246 | 248 | 243 |
| Total lumen (Lm) | 23925 | 22432 | 29761 | 24276 | 27915 | 26211 | 23925 | 20879 |
| Efficacy (Lm/W) | 96 | 92 | 119 | 102 | 112 | 107 | 96 | 86 |
| Correlated color (K) | 4226 | 3952 | 4738 | 4101 | 4429 | 4135 | 4276 | 3755 |
| Chromacity (d.u.v.) | −0.0024 | −0.0086 | 0.0154 | 0.0029 | 0.0048 | 0.0001 | −0.0011 | −0.0090 |
| Color rendtion Ra | 94.2 | 96.3 | 70.3 | 79.0 | 78.6 | 81.3 | 93.8 | 96.2 |
| 1 | | | | | | | | |
| Total Lm | 1493 | | 5485 | | 1704 | | 3046 | |
| CCR (K) | 274 | | 637 | | 294 | | 521 | |
| Chromacity d.u.v. | 0.0062 | | 0.0125 | | 0.0047 | | 0.0079 | |
| Color rendition Ra | 2.1 | | 8.7 | | 2.7 | | 2.4 | |

Key to Table 2:
1 = Amount of change

As will be clear from Table 1 and Table 2, the lamps of the invention radiate a white light that is suitable for general lighting purposes and have emission characteristics that fall within the range of target values for efficiency, correlated color temperature, chromatic deviation d.u.v. and average color rendition index values (color rendition: Ra).

In contrast to the lamps described in the different embodiments of the present invention, lamps that include $DyI_3$ in Comparative Example 1 have a relatively low luminous efficacy. Thus, although these lamps have high values for efficiency and average color rendition index values (color rendition: Ra), the luminous efficacy of these lamps drops to 95 Lm/W and below when the average color rendition index values (color rendition: Ra) exceed 90.

Similarly, lamps which include $CeI_3$ in Comparative Example 2 may not be suitable for general lighting. Thus, although these lamps have a high efficiency of approximately 120 Lm/W, these lamps have an emitted light extremely green, with low average color rendition index values (color rendition: Ra), at approximately 70, and a high value for chromatic deviation d.u.v.

Furthermore, lamps which include $TmI_3$ in Comparative Example 3, while showing improved efficiency and high values for color rendition in contrast to Comparative Example 2, emit an extremely green light such that the values for chromatic deviation d.u.v. are far from the black body radiation level. By including InI in a lamp of Comparative Example 3 for a lamp of Embodiment 2, it may be possible to improve the values of chromatic deviation d.u.v. and to emit a light that is not green.

As will be clear from Table 1 and Table 2, the lamps of the invention in Embodiment 1 and Embodiment 2 have emission characteristics that fall within the range of target values for efficiency, correlated color temperature, chromatic deviation d.u.v. and average color rendition index values (color rendition: Ra). In addition, these lamps radiate a white light that is suitable for general lighting purposes with little variation in emission characteristics during the lifetime of the lamp even when changes in direction of the lighting from vertical (BU) lighting to diagonal lighting, horizontal (BH) lighting diagonal lighting and back to vertical (BD)lighting are operated.

In contrast to the lamps described in the different embodiments of the present invention, lamps of Comparative Example 1 which include $DyI_3$, do not have optimum luminous characteristics. Thus, although these lamps show high values for efficiency and average color rendition index value (color rendition: Ra), the light emitted from the sodium halide and rarer earth halides increases in the red domain in the distribution of emitted light, when the values for this average color rendition index value (color rendition: Ra) exceed about 90. This causes substantial deviation from the visible spectrum line.

Furthermore, lamps of Comparative Example 4 which include $DyI_3$, HoI and $TmI_3$, while having high values of color rendition, show a decrease in efficiency. In addition, although, the values of chromatic deviation (d.u.v.) are not as large as for Comparative Example 2, they still move in the positive direction. Furthermore, the large movement in the negative direction of chromatic deviation (d.u.v.) during the life of the lamp gives the appearance of substantial color change to the human eye, and is unpleasant.

The same types of discharge lamp were also constructed for comparison with the 250 W-rated versions of Embodiments 1, 2 in wattage of 1.4 times their value at 400 W. The characteristics of these lamps correspond to Embodiment 3.

(Embodiment 3)

Discharge lamps were also constructed for comparison with the 250 W-rated versions of Embodiments 1, 2 in wattage of 1.4 times their value at 400 W, and their emission characteristics measured.

In Embodiment 3, arc tube 1A is made of translucent alumina ceramic and has a total length of approximately 80 mm, with an external diameter of bulging section 11 of approximately 22 mm, an internal diameter of approximately 20 mm and and internal volume of about 4.0 cc. In Embodiment 3, the arc tube 1A has a tube wall loading of approximately 26 W/cm$^2$ and has tubular sections 12*a*, 12*b* having an external diameter of small diameter of approximately 2.0 mm and an internal diameter of approximately 1.6 mm.

Electrodes 2A, 2B have electrode shafts 21 of tungsten with an external diameter of approximately 1.0 mm and a length of approximately 8 mm. In Embodiment 3, the electrode coil section 22 is wound from tungsten wire with an external diameter of approximately 0.3 mm, at a pitch density of approximately three turns, the distance of the gap between the two electrodes being approximately 20 mm.

Electrical conductors 23*a*, 23*b* are made of Nb and have an external diameter of approximately 1.5 mm, a length of approximately 15 mm. In Embodiment 3, the molybdenum coil sections 25*a*, 25*b* have an external diameter of approximately 1.4 mm, and a length of approximately 18 mm.

The filled discharge medium includes argon as the start-up or buffer gas at approximately 24 kPa. It also includes 15 mg of a combination of NaI—TlI—InI—$TmI_3$, as the halide, in the proportions of approximately 30 wt %-10 wt %-5 wt %-55 wt %, and approximately 35 mg of mercury Hg.

Outer jacket 5 had a BT shape and was made of hardened glass, with a maximum external diameter of about 116 mm, a maximum internal dimension of about 114 mm (a wall thickness of approximately 1.0 mm) and an overall length of about 300 mm. In Embodiment 3, chamber 1 of arc tube 1A is almost entirely surrounded by inner shroud tube 3.

Thus, as shown in Table 1, lamps of Embodiment 3 also radiate a white light that is suitable for general lighting purposes and have emission characteristics that fall within the range of target values for efficiency, correlated color temperature, chromatic deviation d.u.v., and average color rendition index values (color rendition: Ra).

Figure 14:
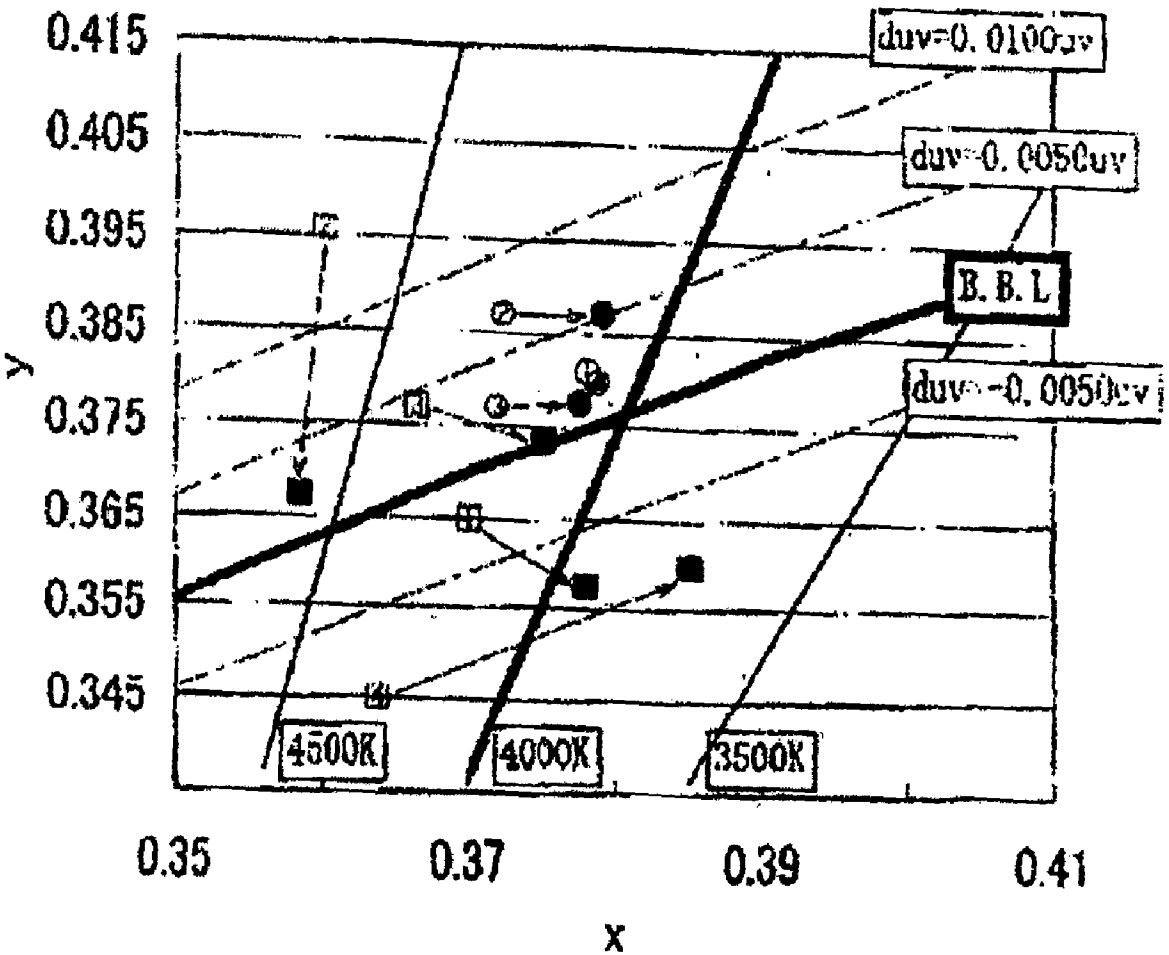
FIG. 14 is a graph representing the variation of chromaticity for different burning positions of the lamp, according to an embodiment of the invention.

When the chromacities of vertical (BU) operation and horizontal (BH) operation are plotted on the x-y chromatic coordinates (CIE 1931) for high-intensity discharge lamps L1 of the above Embodiments 1–3 of the invention, as shown in FIG. 14, the chromatic deviation (d.u.v.) for all the lamps L1 falls within the range of about −0.0050 to +0.0100.

In general, when a change of direction, from vertical to horizontal, is made in the operation of a lamp filled with halides, the emission of the sodium increases, due to an increase in the temperature of the arc tube, the correlated color temperature drops and the value of the chromatic deviation (d.u.v.) moves in a negative direction. However, with the lamp L1 of the present invention, the chromatic deviation (d.u.v.) remains within the range of −0.0050 to +0.0100 due to the effect of the combination of thulium halide and indium halide.

Table 3 is a chart comparing the correlated color temperature (CCT (K)) and the chromatic deviation (d.u.v.) for the lamps of the Embodiments 1–3 and the Comparative Examples 1–4 during vertical (BU) operation and horizontal (BH) operation. FIG. 14 is a graph, compiled on the basis of the results of Tables 1 and 2, corresponding to a chromacity chart that compares chromacity coordinates x on the x-axis with chromacity coordinates y on the y-axis.

In FIG. 14, the circles indicate the Embodiments and the squares the Comparative Examples. The corresponding numbers of the Embodiments and the Comparative Examples are also illustrated. In FIG. 14, white circles and squares correspond to chromacity during vertical (BU) operation and black circles and squares correspond to chromacity during horizontal (BH) operation. Finally, in FIG. 14, identical lamps are joined with straight lines.

TABLE 3

| Operating position | | Vertical (BU) operation | | Horizontal (BH) operation | |
|---|---|---|---|---|---|
| BU → BH | | CCT | d.u.v. | CCT | d.u.v. |
| Embodiment 1 | (1)→● | 4188 | 0.0026 | 4093 | 0.0013 |
| Embodiment 2 | (2)→● | 4276 | 0.0072 | 4119 | 0.0049 |
| Embodiment 3 | (3)→● | 4238 | 0.0028 | 4137 | 0.0009 |
| Comparative Example 1 | [1]→■ | 4226 | −0.0024 | 3952 | −0.0086 |
| Comparative Example 2 | [2]→■ | 4738 | 0.0154 | 4101 | 0.0029 |
| Comparative Example 3 | [3]→■ | 4429 | 0.0048 | 4135 | 0.0001 |
| Comparative Example 4 | [4]→■ | 4276 | −0.0011 | 3755 | −0.009 |

Tables 1 and 2 and FIG. 14 clearly indicate that the high-intensity discharge lamps in the Embodiments of the invention have a correlated color temperature (CCT) within the range of about 3500–5000K, and the values for chromatic deviation (d.u.v.) are in the range of about −0.0050 to +0.010, showing that color characteristics are attained giving stable chromacity with little deviation over operating position. By contrast, the high-intensity discharge lamps of the Comparative Examples, while having values of chromatic deviation (d.u.v.) in the range of about −0.0050 to +0.010, show large values of chromatic deviation (d.u.v.).

In an embodiment of the invention, control of the color characteristics can be achieved by adjusting the relationship M/V between the mass M (mg) of metal halides, filled within arc tube 1A, and the volume V (mm$^3$) of the space within at least one of the small diameter tubular sections 12*a*, 12*b* and tube wall loading (the rating of the lamp (W) per unit area (cm$^2$) of the discharge space.)

In other words, the relationship M/V between the filling weight M (mg) of the metal halides and the volume V (mm$^3$) of the space within the small diameter tubular sections 12*a*, 12*b* and the ends of arc tube 1A has an equivalence with the degree to which the metal halides fill the space within small diameter tubular sections 12*a*, 12*b* (the space between small diameter tubular sections 12*a*, 12*b* and electrical feedthroughs 23*a*, 23*b*). The fact that the value of M/V is small, means that either the filling weight M (mg) of the metal halides is small or the volume V of the space within small diameter tubular sections 12*a*, 12*b* is large. As the metal halides can move about easily and the temperature of the coldest point can greatly fluctuate with a low density of metal halides in the space, there may be a danger that the color characteristics of the lamp will fluctuate greatly. Accordingly, the minimum value for M/V may be around 0.2.

Moreover, a large value of M/V means either that the concentration of the filling weight M of metal halides is too high, or that the volume V of the space within small diameter tubular sections 12*a*, 12*b* is too small. In addition, when the mass M of metal halides filled into the space is too high, the mass of impurities such as $H_2O$ brought in with it will be high, increasing the start-up voltage, and leading to, for example, the blackening of the chamber, and rapid deterioration of the light flux. Therefore, it may be desirable that the value of M/V be kept within the range of 0.2–5.0 in consideration of possible fluctuation.

With respect to tube wall loading (the rating of the lamp (W) per unit area ($cm^2$) of the discharge space), the results indicate in the same way a range of around 12–35 $W/cm^2$.

Thus, by keeping the relationship M/V between the filling weight M (mg) of the metal halides and the volume V ($mm^3$) of the space within at least one of the small diameter tubular sections above 0.2, and by keeping the lamp rating (W) per tube wall loading ($cm^2$) in the range of 12–35 $W/cM^2$, the above effect can be obtained.

It was confirmed that with high-intensity discharge lamps L1 provided with small diameter tubular sections 12*a*, 12*b* at the ends of arc tube 1A with the structures shown in the diagram, satisfactory emission characteristics could be obtained. In such a case, the metal halides were present within the range of ½ of the total length of small diameter tubular sections 12*a*, 12*b* from the end closer to the discharge chamber end of the small diameter tubular sections 12*a*, 12*b* when the lamp is on.

In other words, when the operating position of lamp L1 changes, the metal halides migrate, and the temperature of the coldest point changes. This has an effect on the color characteristics such as correlated color temperature and average color rendition index value. However, it is possible to confirm the presence of metal halides in a liquid phase over ½ the range of the full length of the small diameter tubular sections 12*a*, 12*b* from the side closest to the discharge chamber end of small diameter tubular sections 12*a*, 12*b* at the ends of arc tube 1A, and it is possible to deliver stable color characteristics irrespective of the operating position when lamp L1 is lit.

Moreover, it was confirmed that it may be easy to determine the presence of these metal halides visually using an opaque body or the like. If metal halides are not seen within these small diameter tubular sections 12*a*, 12*b*, this indicates that the quantity present is insufficient, and thus the desired emission characteristics may not be obtained.

With arc tubes 1A-1C having the structures shown in FIGS. 8(*a*)–(*c*), the range of ½ from the side nearest discharge chamber 1 inside small diameter tubular sections 12*a*, (12*b*) indicates one half A/2 of the total length A of small diameter tubular sections 12*a*, 12*b*. This may be adequate if the presence of metal halides can be detected within this A/2 portion of these small diameter tubular sections 12*a* (12*b*).

Figure 15:
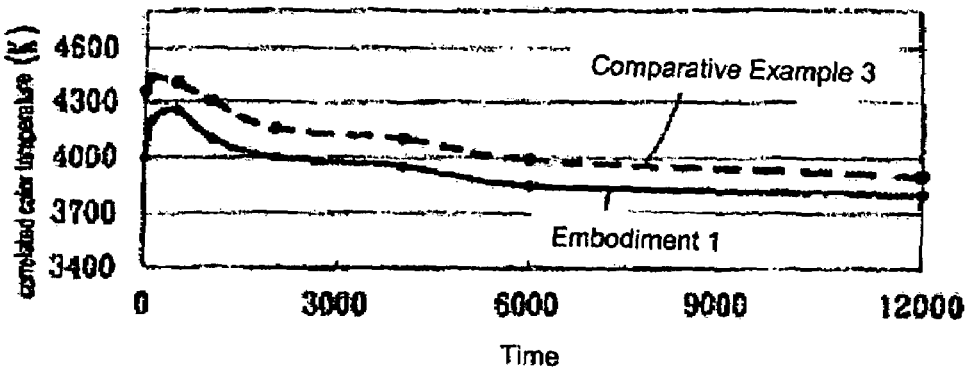
FIG. 15 is a graph showing the results of measurement for changes in the correlated color temperature.
Figure 16:
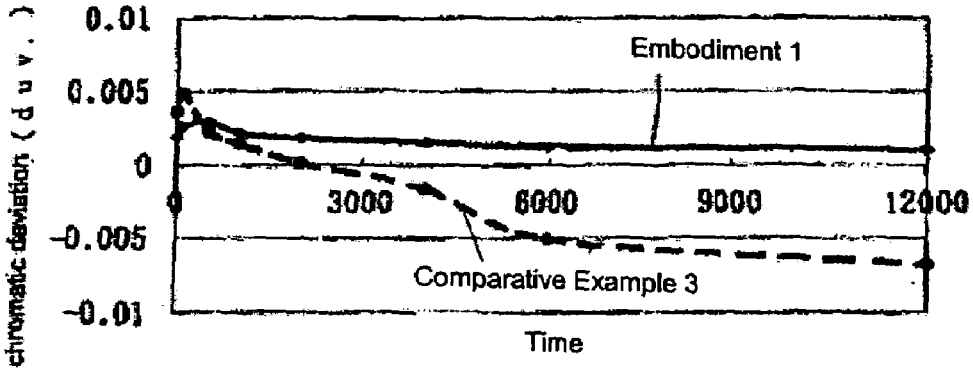
FIG. 16 is a graph showing the results of measurement for changes in the chromatic deviation (d.u.v.)

FIGS. 15 and 16 are graphs showing the results of measurement for changes in the correlated color temperature (K) (FIG. 15) and changes in the value of chromatic deviation (d.u.v.) (FIG. 16) over the life of the lamp by repeating a cycle of 5.5 hours on and 0.5 hours off in vertical (BU) operation using lamp L1 of said Embodiment 1 of the invention and the conventional lamp of Comparative Example 3.

FIG. 15 shows a comparison between life (time) on the x-axis and correlated color temperature (K) on the y-axis. FIG. 16 is a comparison between life (time) on the x-axis and chromatic deviation (d.u.v.) on the y-axis.

The figures clearly indicate that the variation in the color temperature (K) for lamp L1 in the embodiments of the invention is almost identical in terms of maintenance characteristics, but is approximately 200K lower overall throughout the life in comparison to Comparative Example 3.

Moreover, in terms of color deviation (d.u.v.), lamp L1 of Embodiment 1 of the invention shows little chromatic deviance throughout the life of the lamp in comparison to a lamp of Comparative Example 3 for which chromatic deviation varies greatly over the life of the lamp. It is therefore confirmed that lamp L1 of Embodiment 1 of the invention has superior color characteristics in terms of correlated color temperature and chromatic deviation.

Table 4 shows the results of measurements for various emission characteristics of lamps with variations in the ratio of metal halide components. In Table 4, discharge lamps are made in wattage of 250 watts and 400 watts for the same types of Embodiments 1–3.

The measured values shown in Table 4 are the average values obtained by measuring the various emission characteristics both for vertical (BU) operation and horizontal (BH) operation with 10 lamps. In Table 4, measurements were made after the lamps had been lit for 100 hours.

TABLE 4

| | Embodiment 4 | Embodiment 5 | Embodiment 6 | Comparative Example 5 |
|---|---|---|---|---|
| Type of arc tube | Integral type | Integral type | Integral type | Integral type |
| Halide used (% by weight) | NaI, TlI, InI, $TmI_3$ (29:9.5:4:57.5 wt %) | NaI, TlI, InI, $TmI_3$, CsI (27:9:4:56:5 wt %) | NaI, TlI, InI, $TmI_3$ $CeI_3$ (29:9.5:3.5: 49.8 wt %) | NaI, TlI, InI, $CeI_3$ (30:10:5:55 wt %) |
| Operating direction | Vert. BU | Vert. BU | Vert. BU | Vert. BU |
| Lamp voltage (V) | 102.3 | 103.7 | 105.3 | 108.2 |
| Lamp wattage (W) | 395 | 245 | 394 | 244 |
| Total lumen (Lm) | 45820 | 26460 | 46019 | 28060 |
| Efficiency (Lm/W) | 116 | 108 | 116.8 | 115 |
| CCT(K) | 4015 | 4043 | 4186 | 4323 |

TABLE 4-continued

| | Embodiment 4 | Embodiment 5 | Embodiment 6 | Comparative Example 5 |
|---|---|---|---|---|
| Chromacity (d.u.v.) | 0.0021 | 0.0012 | 0.0066 | 0.0233 |
| Color rendition Ra | 83.3 | 84.3 | 82.7 | 71.3 |
| 1 | | | | |
| MTm/M | 0.575 (57.5%) | 0.56 (56%) | 0.49 (49%) | — |
| (MTm + MTl)/M | 0.67 (67%) | 0.65 (65%) | 0.585 (58.5%) | — |
| (MTm + MTl + MIn)/M | 0.71 (71%) | 0.69 (69%) | 0.62 (62%) | — |
| (MIn/M) | 0.04 (4%) | 0.04 (4%) | 0.035 (3.5%) | 0.05 (5%) |
| MIn/ (MTm + MTl) | 0.06 (6%) | 0.06 (6%) | 0.06 (6%) | — |

Key to Table 4:

1=Relationship between halides

The arc tube 1A was made of translucent alumina ceramic and has a total length of approximately 80 mm. In Embodiment 4, the external diameter of bulging section 11 is approximately 22 mm, the internal diameter is approximately 20 mm and the arc tube has an internal volume of 4.0 cc. The tube wall loading is approximately 26 W/cm$^2$, the external diameter of small diameter tubular sections 12*a*, 12*b* are approximately 2.0 mm and the internal diameter is approximately 1.6 mm.

Electrodes 2A, 2B have electrode shafts 21 made of tungsten with an external diameter of approximately 1.0 mm and a length of approximately 8 mm. In Embodiment 4, the electrode coil section 22 is wound from tungsten wire with an external diameter of approximately 0.3 mm, at a pitch density of approximately three turns, the distance of the gap between the two electrodes being approximately 20 mm.

Electrical conductors 23*a*, 23*b* are made of Nb and have an external diameter of approximately 1.5 mm, and a length of approximately 15 mm. The coil sections 25*a*, 25*b* are wound from molybdenum wire and have an external diameter of approximately 1.4 mm and a length of approximately 18 mm.

The discharge medium includes argon as the start-up or buffer gas at approximately 24 kPa. It also includes 15 mg of a combination of NaI—TlI—InI—$TmI_3$, as the halide, in the proportions of approximately 29 wt %-9.5 wt %-4 wt %-57.5 wt %, and approximately 35 mg of mercury Hg.

(1) The ratio by weight to the gross mass of the filled metal halides (Mmg)(=MNamg+MTlmg+MTmmg+MInmg) of $TmI_3$ (MTmmg) is MTm/M, approximately 0.575 (about 57.5%), (2) the ratio by weight to the gross mass of the filled metal halides (Mmg) of $TmI_3$ (MTmmg) and TlI (MTlmg) is (MTm+MTl)/M), approximately 0.67 (about 67%), (3) the ratio by weight to the gross mass of the filled metal halides (Mmg) of $TmI_3$ (MTmmg) and TlI (MTlmg) and InI (MInmg) is (MTm+MTl+MIn)/M, approximately 0.71 (about 71%), (4) the ratio by weight to the gross mass of the filled metal halides (Mmg) of InI (Mimg) is (MIn/M), approximately 0.04 (about 4%), and the ratio by weight to $TmI_3$ (Tmlmg) and TlI (MTlmg) of InI (MInmg) is (MIn/MTm+MTl), approximately 0.06 (about 6%), each case being within the restrictive range of values of the invention.

Outer jacket 5 has a BT shape and was made of hardened glass, with a maximum external diameter of about 116 mm, a maximum internal dimension of about 114 mm (a wall thickness of approximately 1.0 mm), an overall length of about 300 mm. In Embodiment 4, the chamber 1 of the arc tube 1A is almost completely surrounded by inner shroud tube 3.

Table 1 clearly indicates that the lamp of Embodiment 3 also has emission characteristics that fall within the target range for efficiency, correlated color temperature and average color rendition index values (color rendition: Ra), and thus radiates white light that is suitable for general lighting.

(Embodiment 5)

In Embodiment 5, there is provided a high-intensity discharge lamp having the same structure and rating as those shown in FIG. 1 and FIG. 2. In Embodiment 5, the constituents of the metal halides used differ from lamp L1 of Embodiment 1.

The lamp has a rating of 250 W and has a filled discharge medium of approximately 10mg. The discharge medium is a combination of NaI—TlI—InI—$TmI_3$ with added CsI in the approximate proportions of 27 wt %-9 wt %-4 wt %-56 wt %-5 wt %, with approximately 13 mg of mercury Hg.

(1) The ratio by weight of $TmI_3$ (MTmmg) to the gross mass of the sealed metal halides (Mmg)(Mmg=MNamg+MTlmg+MTmmg+MInmg) is MTm/M, approximately 0.56 (about 56%), (2) The ratio by weight to the gross mass of the sealed metal halides (Mmg) of $TmI_3$ (MTmmg) and TlI (MTlmg) is (MTm+MTl)/M, approximately 0.65 (about 65%), (3) The ratio by weight to the gross mass of the sealed metal halides (Mmg) of $TmI_3$ (MTmmg) and TlI (MTlmg) and InI (MInmg) is (MTm+MTI+MIn)/M, approximately 0.69 (about 69%), (4) The ratio by weight to the gross mass of the sealed metal halides (Mmg) of InI (Mimg) is (Min/M), approximately 0.04 (about 4%), and the ratio by weight to $TmI_3$ (MTlmg) and TlI (MTlmg) of InI (MInmg) is (MIn/MTm+MTl), approximately 0.06 (about 6%), each case being within the restrictive range of values of the invention.

In Embodiment 6, there is provided a high-intensity discharge lamp having the same structure and rating as that of Embodiment 3. In Embodiment 6, the constituents of the metal halides differ from lamp L1 of Embodiment 3.

The lamp has a rating of 400 W and has a filled discharge medium of approximately 14 mg. The discharge medium includes a combination of NaI—TlI—InI—$TmI_3$—$CeI_3$ in the approximate proportions of 29 wt %-9.5 wt %-3.5 wt %-49 wt %-8 t %, with approximately 30 mg of mercury Hg.

It was confirmed that all the lamps of said Embodiments 1–6 have emission characteristics, such as total light flux (Lm), efficiency (Lm/W), correlated color temperature (K), dramatic deviation (d.u.v.) and average color rendition index value (color rendition: Ra) that fall within the target values.

Figure 17:
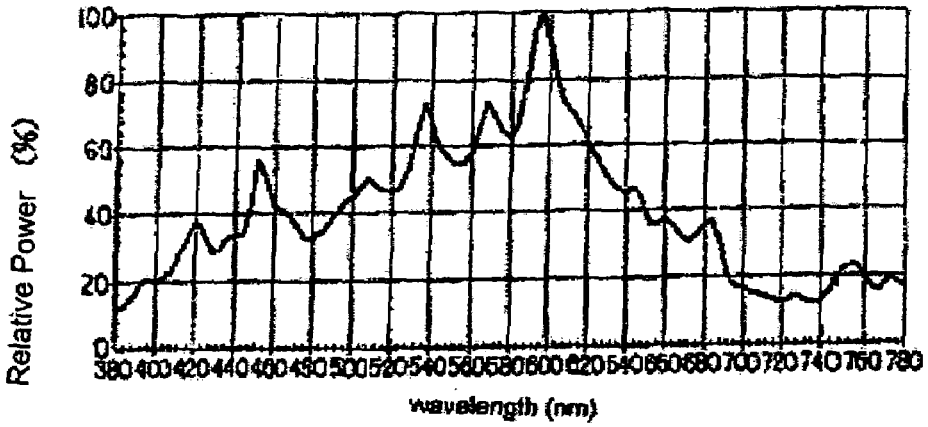
FIG. 17 is a graph representing the variation of the relative power as a function of the wavelength (nm) according to an embodiment of the invention.
Figure 18:
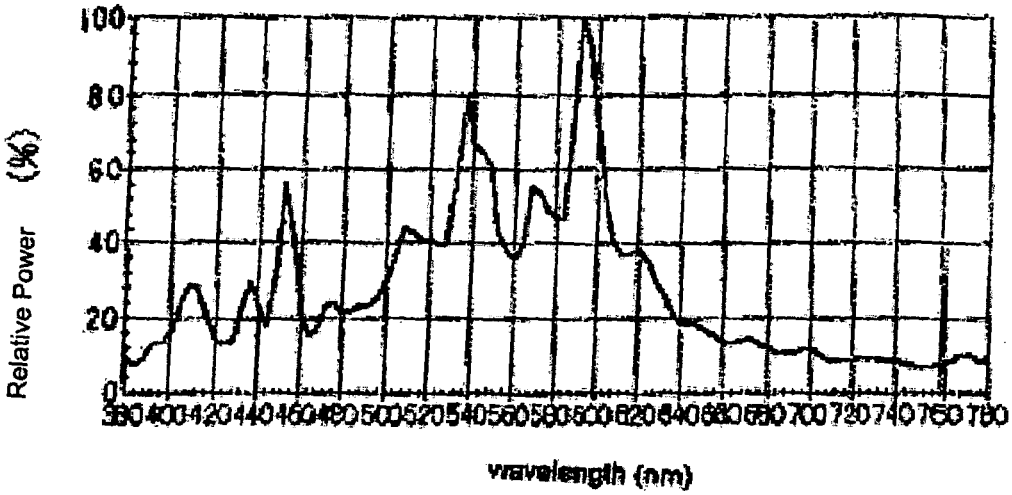
FIG. 18 is a graph showing the variation of the relative power as a function of the wavelength (nm) according to an embodiment of the invention.

FIG. 17 is a graph representing the variation of the relative power (%) (on the y-axis) as a function of wavelength (nm) (on the x-axis). More particularly, FIG. 17 represents the spectral distribution characteristics (spectrum) of Embodiment 4. FIG. 18 shows the spectral distribution of Comparative Example 5. These figures clearly indicate that lamps of Embodiment 4 deliver a spectral distribution close to that of the visible spectrum, and that a white light with good efficiency and color rendition may be obtained.

It should be understood that the invention may also be applied to lamps with a power rating of between 10–1000 W. Table 5 shows the characteristics of lamps manufactured according to the present invention. These lamps correspond to various representative types of lamps and satisfy the conditions for the filled halides of the present invention.

The relationship M/V between the filling weight M (mg) of the metal halides and the volume V ($mm^3$) of the space within the small diameter tubular sections and the ends of arc tube has an equivalence with the degree to which the metal halides fill the space within small diameter tubular sections (the space between small diameter tubular sections and the electrical feed-throughs). Therefore, the fact that the value of M/V is small means that either the filling weight M (mg) of the metal halides is small or the volume V of the space within small diameter tubular sections is large. In addition, as the metal halides can migrate easily and the temperature of the coldest point can greatly fluctuate with a low density of metal halides in the space, there may be a danger that the color characteristics of the lamp will fluctuate greatly. Accordingly, the minimum value for M/V may be around 0.2.

Moreover, a large value of M/V means either that the concentration of the filling weight M of metal halides is too high, or that the volume V of the space within small diameter tubular sections is too small. When the mass M of the metal halides filled into the space is too high, the mass of impurities such as $H_2O$ brought in with it will be high, This increases the start-up voltage, leading, for example, to the blackening of the chamber, and rapid deterioration of the light flux. Therefore, it may be desirable that the value of M/V be kept to a maximum of 5.0 in consideration of possible fluctuation.

With respect to tube wall loading (the rating of the lamp (W) per unit area ($cm^2$) of the discharge space), the results indicate, in the same way, a range of around 12–35 $W/cm^2$.

Further, with the translucent ceramic discharge chamber having small diameter tubular sections at both ends of the bulging section forming the discharge chamber, these small diameter tubular sections (the coldest point) reduce the thermal resistance and help enable a uniform temperature distribution throughout the arc tube.

If the mass of filled metal halides and the tube wall loading (12–35 $W/cm^2$) is kept within the restrictive range of the invention, the desired emission characteristics can be obtained by controlling the M/V ratio. This is so because the rate of thermal transmission of the alumina or other ceramic material that constitute the arc tube of the discharge chamber is higher than that of quartz glass. Therefore, there is a more uniform temperature distribution in the arc tube when the lamp is on. This may also be due to the fact that the control of the filling weight M of the metal halides with respect to the volume V of the space within the small diameter tubular sections indirectly contributes to the control of the temperature of the coldest point.

At the same time, if the quantity of mercury filled within the arc tube as a discharge medium is less than 3 mg for 1 cc of the volume of the arc tube, the desired lamp voltage may not be obtained. However, if the volume exceeds 25 mg per 1 cc of the volume of the arc tube, the lamp voltage may rise above that which is desired, leading to lamp fading. The amount of mercury should ideally be between 4–22 mg.

With discharge lamps employing metal halides, emission characteristics and electrical characteristics, such as efficiency and color temperature, may vary as the evaporation pressure of the halides changes with changes in the coldest point, due to the operating position. In the present invention, it is however possible to keep changes in the correlated color temperature of the lamp to 500K or below.

The reason why the correlated color temperature changes are held to 500K or less is that with a temperature difference of above 500K the difference in the light is visible to the human eye.

It should be understood that the power rating of the lamp can be between 10–1000 W. Thus, while restrictions are generally imposed on lighting direction for conventional lamps, by adopting the structure of the invention, the emission characteristics can be improved without limiting the operating position. In addition, a power rating of between 10–1000 W allows leeway in the rating of 10–1000 W class lamps.

While a detailed description of presently preferred embodiments of the invention have been given above, various alternatives, modifications, and equivalents will be apparent to those skilled in the art without varying from the spirit of the invention. Therefore, the above description should not be taken as limiting the scope of the invention, which is defined by the appended claims.

TABLE 5

| Lamp wattage (W) | 20 | 35 | 100 | 150 | 250 | 400 | 700 |
|---|---|---|---|---|---|---|---|
| Tube wall load ($W/cm^2$) | 26.2 | 26.2 | 29.3 | 28.8 | 28.2 | 26.7 | 24.1 |
| Halide used (% weight) | Na I, TlI, InI, $TmI_3$ (26:13:3:58 wt %) | | | | Na I, TlI, InI, $TmI_3$ (28:9:7:56 wt %) | | |
| Quantity (mg) | 2 | 4 | 5 | 6 | 7 | 12 | 18 |
| Efficacy (Lm/W) | 108.7 | 109.3 | 116.4 | 115.7 | 116.2 | 113.5 | 106.5 |
| Color temperature (K) | 3622 | 3713 | 3867 | 3952 | 4036 | 4105 | 4288 |
| Color rendition (Ra) | 86.5 | 82.5 | 88.3 | 81.7 | 84.6 | 83.9 | 81.3 |

What is claimed is:

1. A high-intensity discharge lamp including an arc tube, the arc tube comprising:

a translucent ceramic discharge chamber that defines a discharge volume, said chamber having a pair of end sections provided at both ends of a central section;

a pair of feedthroughs, each of said feedthroughs being hermetically sealed within one of said end sections respectively; and a pair of electrodes, each of said electrodes comprising a tip that extends towards the central section and is connected to one of said feedthroughs, wherein the discharge chamber is filled with a discharge medium including a metal halide and a starting gas, said metal halide comprising at least halides of Na, Tl, and Tm, and wherein the ratio (MTm/M) of the mass MTm of Tm halide to the total mass M of said metal halide is within a range of about $0.4 \leqq MTm/M \leqq 0.9$.

2. A high-intensity discharge lamp according to claim 1, wherein the total mass of the halides of Na, Tl and Tm is greater than 90% by weight of the total mass M of the metal halide.

3. A high intensity discharge lamp according to claim 1, wherein the end sections are tubular sections which have a constant diameter.

4. A high intensity discharge lamp according to claim 1, wherein the central section is provided with a given diameter.

5. A high intensity discharge lamp according to claim 4, wherein the internal diameter of the central section is greater than the internal diameter of the end sections.

6. A high intensity discharge lamp according to claim 4, wherein the central section is bulgy or ramp-like with increasing diameter including a most extended diameter.

7. A high-intensity discharge lamp including an arc tube, the arc tube comprising:

a discharge chamber having a pair of end sections;

a pair of feedthroughs, each of said feedthroughs being hermetically sealed within one of said end sections of the discharge chamber, respectively;

a pair of electrodes, each of said electrodes being connected to one of said feedthroughs;

wherein the discharge chamber is filled with a discharge medium including a metal halide that comprises at least halides of Na, Tl, In, and Tm and a starting gas; and wherein the total mass of the halides of Na, Tl, In and Tm is greater than 90% of the total mass of the metal halide.

8. A high-intensity discharge lamp including an arc tube, the arc tube comprising:

a discharge chamber having a pair of end sections;

a pair of feedthroughs, each of said feedthroughs being hermetically sealed within one of said end sections of the discharge chamber, respectively;

a pair of electrodes, each of said electrodes being connected to one of said feedthroughs;

wherein the discharge chamber is filled with a discharge medium including a metal halide that comprises at least halides of Na, Tl, In, and Tm and a starting gas; and wherein the ratio (MTm/M) of the mass MTm of said Tm halide to the total mass M of said metal halide is within a range of about $0.4 \leqq MTm/M \leqq 0.9$.

9. A high-intensity discharge lamp including an arc tube, the arc tube comprising:

a discharge chamber having a pair of end sections;

a pair of feedthroughs, each of said feedthroughs being hermetically sealed within one of said end sections of the discharge chamber; and a pair of electrodes, each of said electrodes being connected to one of said feedthroughs, wherein the discharge chamber is filled with a discharge medium including a metal halide and a starting gas, said metal halide comprising at least halides of Na, Tl, In, and Tm, wherein the ratio (MTm/M) of the mass MTm of said Tm halide to the total mass M of said metal halide is within a range of about $0.4 \leqq MTm/M \leqq 0.9$, and wherein the total mass of the halides of Na, TI, In, Tm halides is greater than 90% of the total mass M of the metal halide.

10. A high-intensity discharge lamp according to claim 9, wherein the ratio (MTm+MTl+MIn)/M of the sum of the mass MTm of the Tm halide and the mass MTl of the Tl halide and the mass MIn of the In halide to the total mass M of the metal halide is within a range of about $0.61 \leqq (MTm+MTl+MIn)/M \leqq 0.9$, and wherein the ratio (MIn/M) of the mass of the In halide to the total mass M of the metal halide is within a range of about $0.01 \leqq MIn/M \leqq 0.1$.

11. A high-intensity discharge lamp according to any one of claims 1, 2, 7, and 9, wherein the metal halide further comprises at least one metal halide selected from the group of metals consisting of Ce, Pr, Ca, Cs, Li, Mg and Rb.

12. A high-intensity discharge lamp according to any one of claims 1, 2–9, wherein the deviation in chromaticity (d.u.v.) of the light, emitted during the life of the lamp, on the x-y chromaticity coordinates (CIE 1931) is within the range of about −0.006 to +0.010, wherein the correlated color temperature is within the range of about 3500 to 5000 K, wherein the average color rendition index value (Ra) is within the range of about 75–95, and wherein the luminous efficacy is within the range of about 95–130 lm/W.

13. A high-intensity discharge lamp according to claim 12, wherein the deviation in chromaticity (d.u.v.) of the light, emitted during the life of the lamp, on the x-y chromaticity coordinates (CIE 1931) is within the range of about −0.003 to +0.007.

14. A high-intensity discharge lamp according to any one of claims 1, 2–9, further comprising an outer jacket, which hermetically encloses said arc tube, and a pair of feeder members, which are configured to support and position the arc tube relative to said outer jacket, wherein the pair of feeder members is sealed within an end of said outer jacket and is electrically connected to said feedthroughs, and wherein the pressure in the volume defined by the outer jacket at ambient temperature is at most 133 Pa.

15. A high-intensity discharge lamp according to any one of claims 1, 2–9, further comprising an inner shroud disposed within an outer jacket, which hermetically encloses said arc tube, and surrounding the arc tube, said shroud being made of quartz glass whose spectral transmittance in the wavelength range of about 220–370 nm is about 60% or higher.

16. A lighting device comprising a lamp according to any one of claims 1, 2–9 and a lighting circuit configured to supply a voltage to the lamp, wherein the lamp voltage waveform when the lamp is lit is a rectangular waveform in the range of about 100 Hz–1 kHz, and wherein the light circuit has a secondary open circuit voltage in the range of about 150–400 V.

17. A lighting device comprising a lamp according to any one of claims 1, 2–9 and a lighting circuit which is configured to light said lamp by a dimming operation.

18. A high intensity discharge lamp according to any one of claims 1 and 9, wherein the lamp further comprises an outer jacket which hermetically encloses said arc tube.

19. A high intensity discharge lamp according to claim 18, further comprising a pair of feeder members configured to support and position the arc tube within the outer jacket, the feeder members being sealed within an end of said outer jacket and electrically connected to said feedthroughs.

20. A high-intensity discharge lamp including an arc tube, the arc tube comprising:

a discharge chamber having a pair of end sections;

a pair of feedthroughs, each of said feedthroughs being hermetically sealed within one of said end sections of the discharge chamber, respectively;

a pair of electrodes, each of said electrodes being connected to one of said feedthroughs;

wherein the discharge chamber is filled with a discharge medium including a metal halide that comprises at least halides of Na, Tl, In, and Tm and a starting gas; and wherein the ratio (MTm+MTl+MIn)/M of the sum of the mass MTm of the Tm halide and the mass MTl of the Tl halide and the mass MIn of the In halide to the total mass M of the metal halide is within a range of about $0.61 \leqq (MTm+MTl+MIn)/M \leqq 0.9$, and wherein the ratio (MIn/M) of the mass of the In halide to the total mass M of the metal halide is within a range of about $0.01 \leqq MIn/M \leqq 0.1$.

* * * * *